US007425255B2

(12) United States Patent
Detor et al.

(10) Patent No.: US 7,425,255 B2
(45) Date of Patent: Sep. 16, 2008

(54) METHOD FOR PRODUCING ALLOY DEPOSITS AND CONTROLLING THE NANOSTRUCTURE THEREOF USING NEGATIVE CURRENT PULSING ELECTRO-DEPOSITION

(75) Inventors: Andrew J. Detor, Somerville, MA (US); Christopher A. Schuh, Ashland, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 130 days.

(21) Appl. No.: 11/147,146

(22) Filed: Jun. 7, 2005

(65) Prior Publication Data

US 2006/0272949 A1 Dec. 7, 2006

(51) Int. Cl.
*C25D 5/18* (2006.01)
*C25D 3/56* (2006.01)

(52) U.S. Cl. ..... 205/81; 205/103; 205/176; 205/238; 205/255

(58) Field of Classification Search ..... 205/81, 205/176, 238, 255, 103
See application file for complete search history.

(56) References Cited

U.S. PATENT DOCUMENTS

| | | | | |
|---|---|---|---|---|
| 4,514,265 | A | 4/1985 | Rao et al. | |
| 4,652,348 | A | 3/1987 | Yahalom et al. | |
| 5,352,266 | A | 10/1994 | Erb et al. | |
| 5,433,797 | A | 7/1995 | Erb et al. | |
| 5,489,488 | A | 2/1996 | Asai et al. | |
| 5,972,192 | A | 10/1999 | Dubin et al. | |
| 6,036,833 | A | 3/2000 | Tang et al. | |
| 6,203,684 | B1 | 3/2001 | Taylor et al. | |
| 6,210,555 | B1 | 4/2001 | Taylor et al. | |
| 6,319,384 | B1 | 11/2001 | Taylor et al. | |
| 6,402,924 | B1 | 6/2002 | Martin et al. | |
| 6,723,219 | B2 | 4/2004 | Collins | |
| 6,863,793 | B2 * | 3/2005 | Taylor et al. | 205/103 |
| 6,881,318 | B2 * | 4/2005 | Hey et al. | 205/87 |
| 2005/0109626 | A1 | 5/2005 | Kruger et al. | |

OTHER PUBLICATIONS

A. Kenneth Graham, editor, Electroplating Engineering Handbook, Reinhold Publishing Corporation, New York, 1962, pp. 55.*

(Continued)

*Primary Examiner*—Susy Tsang-Foster
*Assistant Examiner*—William T Leader
(74) *Attorney, Agent, or Firm*—Steven J. Weissburg

(57) ABSTRACT

Bipolar wave current, with both positive and negative current portions, is used to electrodeposit a nanocrystalline grain size deposit. Polarity Ratio is the ratio of the absolute value of the time integrated amplitude of negative polarity current and positive polarity current. Grain size can be precisely controlled in alloys of two or more chemical components, at least one of which is a metal, and at least one of which is most electro-active. Typically, although not always, the amount of the more electro-active material is preferentially lessened in the deposit during times of negative current. The deposit also exhibits superior macroscopic quality, being relatively crack and void free. Parameters of current density, duration of pulse portions, and composition of the bath are determined with reference to constitutive relations showing grain size as a function of deposit composition, and deposit composition as a function of Polarity Ratio, or, perhaps, a single relation showing grain size as a function of Polarity ratio.

22 Claims, 16 Drawing Sheets

OTHER PUBLICATIONS

Kumar, K.S., Swygenhoven, H. Van, and Suresh S., "Mechanical behavior of nanocrystalline metals and alloys", Acta Materialia, (2003). 51(19): p. 5743-74.

Pande, C.S., Masumura, R.A., and Hazzledine, P.M., "Yield stress of nanocrystalline materials", Materials Physics and Mechanics, (2002). 5(1): p. 16-22.

Nee, C.C., Kim, W., and Weil, R., "Pulsed Electrodeposition of Ni-Mo Alloys", Journal of the Electrochemical Society, (1988): p. 1100-1103.

Tsai, W.-C., Wan, C.-C., and Wang, Y.-Y., "Mechanism of copper electrodeposition by pulse current and its relation to current efficiency", Journal of Applied Electrochemistry, (2002). 32(12): p. 1371-8.

Qu, N.S., Chan, K.C., and Zhu, D., "Surface roughening in pulse current and pulse reverse current electroforming of nickel", Surface and Coatings Technology, (1997). 91(3): p. 220-4.

Chassaing, E., Roumegas, M.P., and Trichet, M.F., "Electrodeposition of Ni-Mo alloys with pulse reverse potentials", Journal of Applied Electrochemistry, (1995). 25(7): p. 667-70.

Karolus, M. and Lagiewka, E., "Studies on electrodeposited Ni-Mo nanocrystalline alloy", Diffusion and Defect Data Part B (Solid State Phenomena), Interfacial Effects and Novel Properties of Nanomaterials. Symposium C, (Sep. 14-18, 2002, 2003). 94: p. 217-20.

Farber, B., et al., "Phosphorus segregation in nanocrystalline Ni-3.6 at.% P alloy investigated with the tomographic atom probe (TAP)", Acta Materialia, (2000). 48(3): p. 789-96.

Weissmuller, J., "Alloy effects in nanostructures", Nanostructured Materials, First International Conference on Nanostructured Materials, (Sep. 22-26, 1992, 1993). 3(1-6): p. 261-72.

Zhang, Z., Zhou, F., and Lavernia, E.J., "On the analysis of grain size in bulk nanocrystalline materials via x-ray diffraction", Metallurgical and Materials Transactions A (Physical Metallurgy and Materials Science), (2003). 34A(6): p. 1349-55.

Ungar, T., "The meaning of size obtained from broadened X-ray diffraction peaks", Advanced Engineering Materials, (2003). 5(5): p. 323-9.

Tian, H.H. and Atzmon, M., "Comparison of X-ray analysis methods used to determine the grain size and strain in nanocrystalline materials", Philosophical Magazine A (Physics of Condensed Matter: Structure, Defects and Mechanical Properties), (1999). 79(8): p. 1769-86.

Yamasaki, T., et al., "Formation of ductile amorphous and nanocrystalline Ni-W alloys by electrodeposition", Plating and Surface Finishing, (2000): p. 148-152.

Svensson, M. Wahlstrom, U. and Holmbom, G., "Compositionally modulated cobalt-tungsten alloys deposited from a single ammoniacal electrolyte", Surface and Coatings Technology, 105, (1998): p. 218-223.

International Search Report, PCT/US2006/19830, mailed on Aug. 22, 2007.

Written Opinion, PCT/US2006/19830, mailed on Aug. 22, 2007.

* cited by examiner

METHOD FOR PRODUCING ALLOY DEPOSITS AND CONTROLLING THE NANOSTRUCTURE THEREOF USING NEGATIVE CURRENT PULSING ELECTRO-DEPOSITION

GOVERNMENT RIGHTS

The United States Government has certain rights in this invention pursuant to the U.S. Army Research Office contract/grant #DAAD19-03-1-0235.

A partial summary is provided below, preceding the claims.

The inventions disclosed herein will be understood with regard to the following description, appended claims and accompanying drawings, where:

INTRODUCTION

Figure 1:
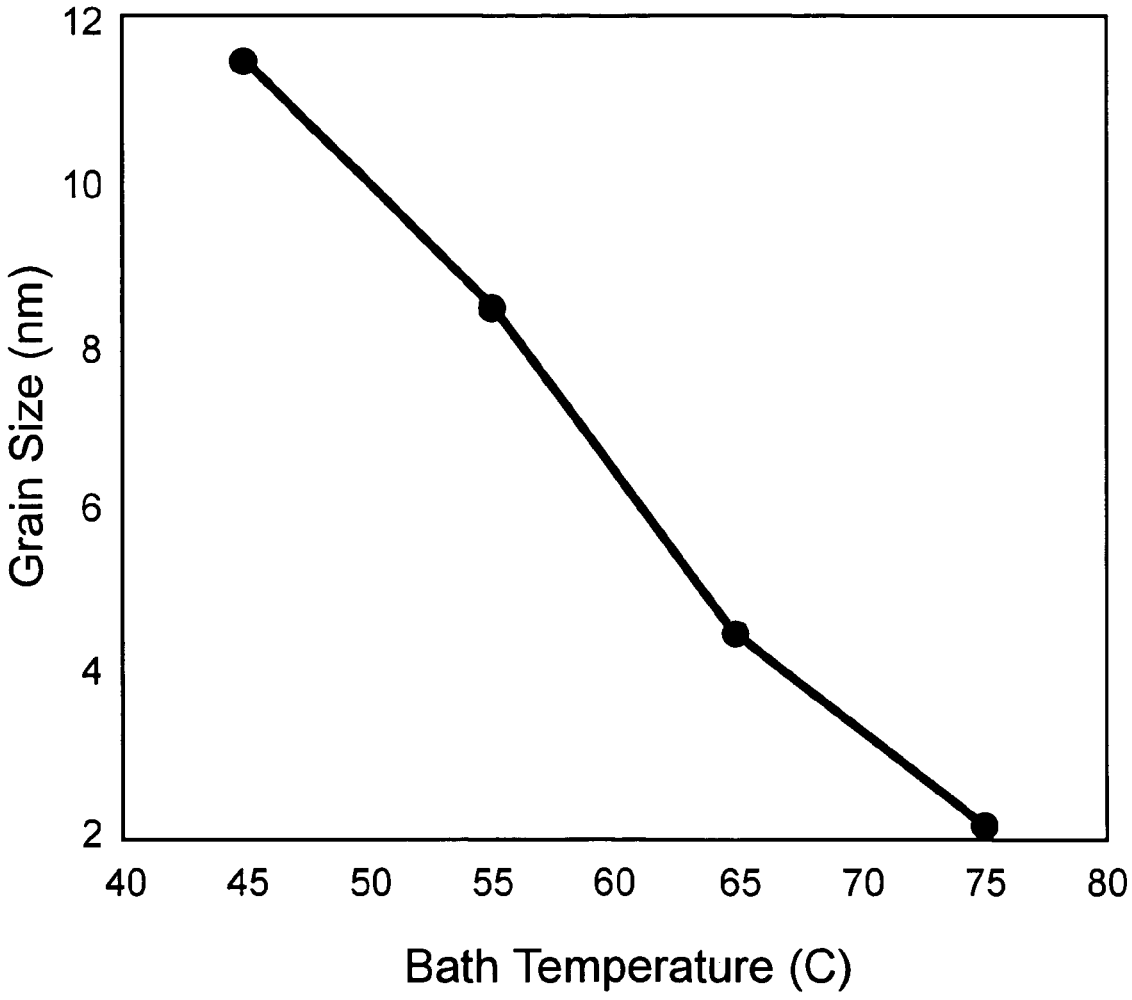
FIG. 1 is a graphical representation showing grain size on the vertical axis as a function of liquid temperature on the horizontal axis.

Nanocrystalline metals are characterized by a grain size on the order of nanometers up to one micron in size. Much research effort has focused on the study of these materials due to their exceptional combination of properties. Yield strength, which is of interest for mechanical design, is inversely linked to grain size, such that as the grain size decreases, the yield strength increases. One motivation for the study of nanocrystalline metals has been to exploit this trend as grain size is reduced to near atomic length scales. Indeed, nanocrystalline metals offer yield strengths much higher than their larger than micro-meter scale crystalline (microcrystalline) counterparts, and along with this increase in strength, nanocrystalline metals can offer other benefits, such as enhanced ductility, exceptional corrosion and wear resistance, and desireable magnetic properties.

The magnetic properties of nanocrystalline metals can show a higher combination of permeability and saturation magnetic flux density than possible in traditional microcrystalline metals. These properties are important for soft magnetic applications and are enhanced as grain size is decreased to the nano-scale.

As used in this specification and in the claims attached hereto, nanocrystalline shall mean crystal structures having an average grain size of up to 1000 nm. Also, unless otherwise indicated, when grain size is mentioned in this specification and in the claims, average grain size is meant.

Processing nanocrystalline metals is regarded as challenging, because they necessarily exhibit far-from-equilibrium microstructures. Various methods have been used to refine grain size to the nanometer scale, the most prominent of which are severe plastic deformation, compaction of nanocrystalline powders, and electrodeposition.

The compaction method inevitably incorporates impurities into the material, which is undesirable. The compaction method is also limited to shapes that can be formed from compacted sintered powder, which shapes are limited. Relatively large amounts of energy are needed to practice the severe plastic deformation methods. Further, they are not easily scalable to industrial scales, and cannot generally produce the finest grain sizes in the nanocrystalline range without a significant increase in costs.

Electrodeposition does not suffer from these drawbacks. For coating applications, electrodeposition can be used to plate out metal on a conductive material of virtually any shape, to yield exceptional surface properties. Electrodeposition also generally produces high purity materials. An electrodeposition process is scalable and requires relatively low energy. These characteristics make it an ideal choice for industrial scale operations, not only from a technical but also from an economic point of view.

In addition to these advantages, electrodeposition also offers several avenues for grain size control. Several variables in the process can be adjusted to yield materials of a specified average grain size. It is mainly for this reason that electrodeposition has been extensively used to study structure-property relationships in nanocrystalline metals. Typical variables that have been used to control grain size include current density, liquid temperature, and liquid composition, each of which will affect some facet of the resulting deposit.

For instance, as shown with reference to FIG. 1, there is in some systems a relationship between liquid temperature and crystal grain size.

In electrodeposition, a potential is applied across an anode and a cathode placed in a solution containing metallic ions. Under the influence of the electric field, a current is developed in the solution where positive metal ions are attracted to and deposited at the cathode surface. After depositing at the cathode, metal atoms arrange into a thermodynamically stable or metastable state.

Figure 2A:
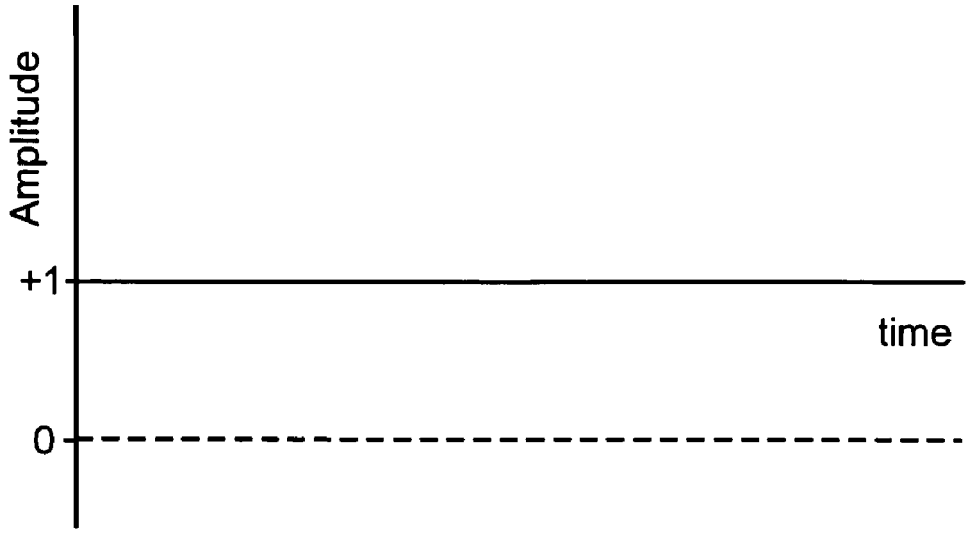
Fig. 2A (Prior art)
FIG. 2A is a schematic rendition of a direct current waveform of prior art methods of electroplating.
Figure 2B:
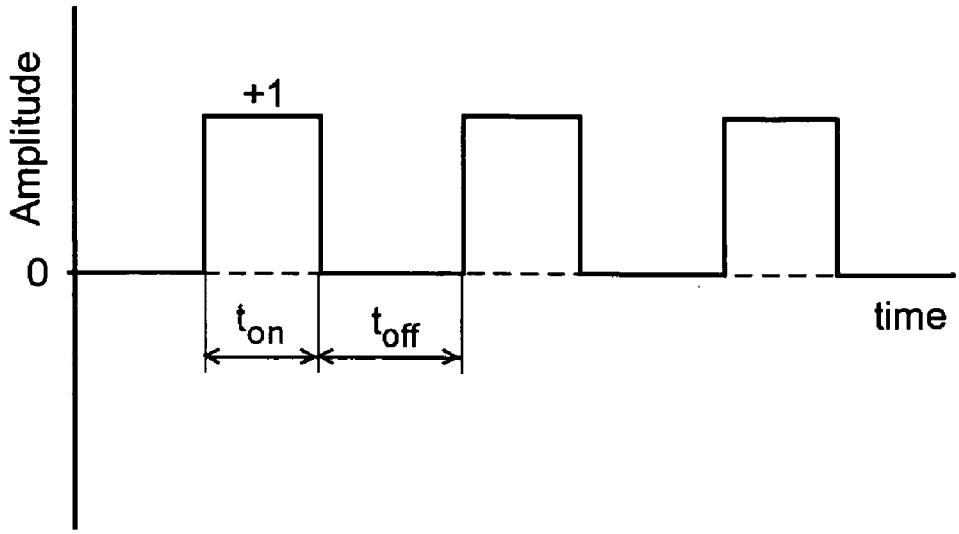
Fig. 2B (Prior art)
FIG. 2B is a schematic rendition of a unipolar pulsing (UPP) current waveform of prior art methods of electroplating.

Traditional electrodeposition employs a constant steady current between an anode and a cathode, referred to as direct current (DC). Another type of current, known as unipolar pulsed current (UPP) is also being used. This current pulsing employs periodic "off-time," where no current flows. These two current types are illustrated schematically in FIGS. 2A and 2B, respectively. Typically the characteristic pulse times, $t_{on}$, $t_{off}$, are on the order of 0.1-100 ms. This pulsing has been shown to benefit the current efficiency, surface leveling, and stress characteristics of the deposit.

Figure 3:
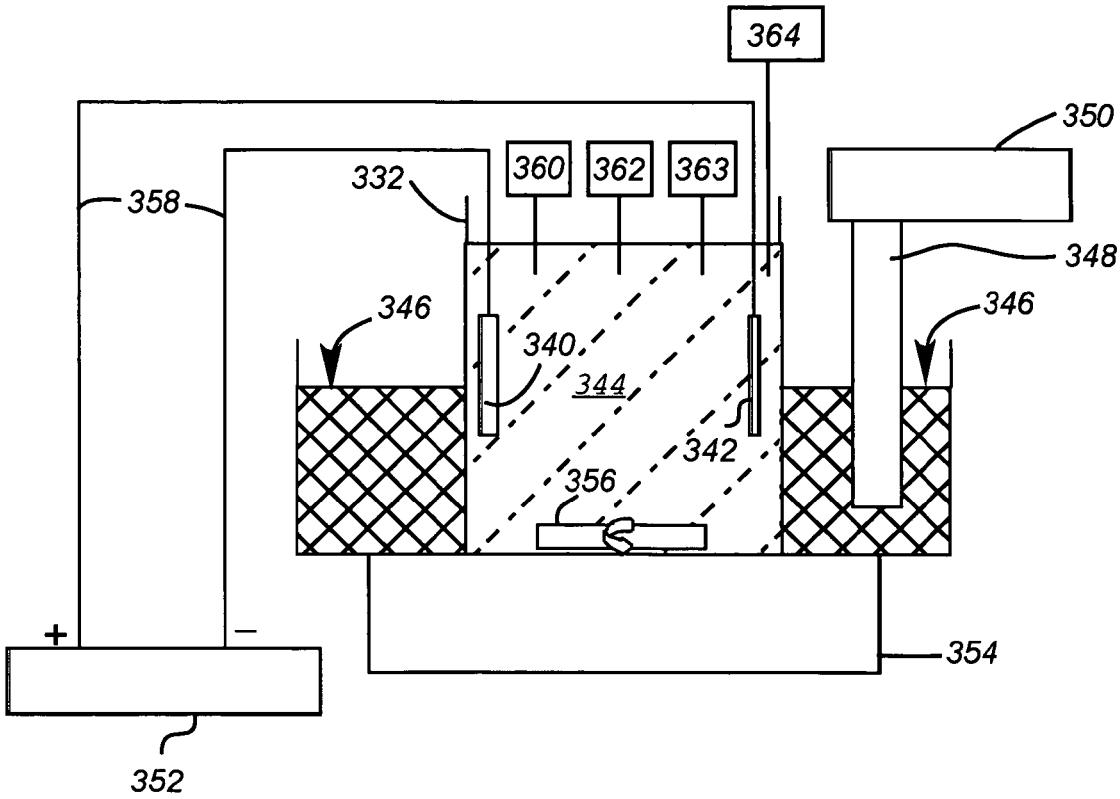
FIG. 3 is a schematic representation of an apparatus invention hereof, suitable for practicing a method of an invention hereof.

A basic hardware set-up that can be used for practicing a method of an invention hereof is shown schematically in block diagram form in FIG. 3. A vessel 332 contains a liquid 344, such as an electrolyte bath, in which are found the components that will form the nanocrystalline metal, such as metal ions. A nominal cathode electrode 340 and a nominal anode electrode 342 are immersed in the liquid 344, and are coupled through conductors 358 to a power supply 352. (As shown, the electrodes are simple individual conductors. However, an electrode can be one or more electrically conductive bodies, electrically coupled in parallel with each other.) A magnetic stirrer 354 has a moving part 356 that is within the vessel 332. An oil bath 346 surrounds the liquid vessel 332. A heater 348 is immersed in the oil bath 346, and is controlled by a thermal controller 350. The power supply 352, is capable of applying both positive and negative polarity pulses. It and the thermal controller 350 and magnetic stirrer 354, may all be controlled by a single computerized controller, which is not shown, or by individual controllers that are governed by a human operator. A temperature sensor 360 measures the temperature of the liquid 344.

In operation, a potential difference is applied by the power supply between the nominal anode 342 and the cathode 340. This difference causes ions in the liquid to be drawn toward the nominal cathode 340, upon which they are deposited. If the conditions are controlled properly, the deposit grain size can be controlled to a fine degree. There may be one or more anodes.

The grain size of a multi-component electrodeposit can be controlled by a variety of known means. One of the most prominent methods used in the literature is the precise control of bath temperature. This effect is illustrated in FIG. 1, which graphically presents the grain size as a function of bath temperature relationship for the Ni—W system, with all other deposition variables held constant. The data in FIG. 1 were produced by the inventors hereof, but reproduce a well-known trend in this alloy system. As can be seen, over a range of between 45° C. and 75° C., the grain size drops from about 11.5 nm to about 2 nm. The slope of this curve (change in grain size divided by change in temperature) is negative, with increasing temperature resulting in smaller grain size.

Figure 4:
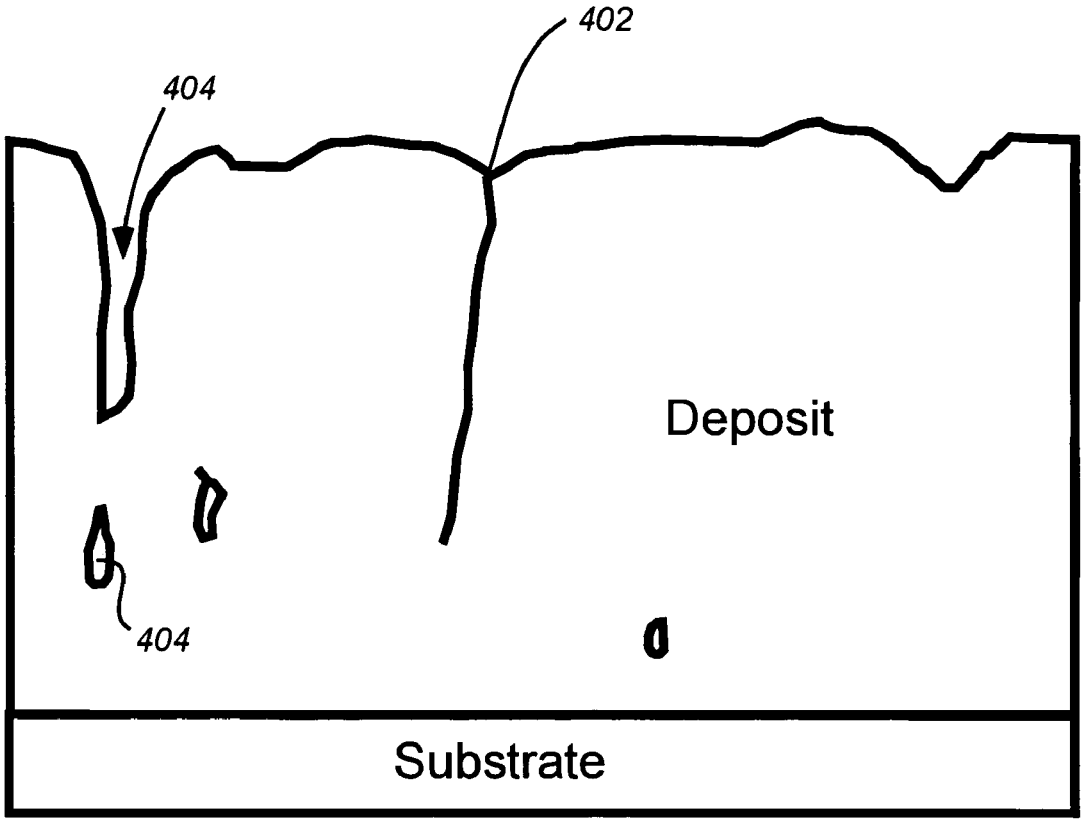
Fig. 4 (Prior Art)
FIG. 4 is a schematic rendition of a scanning electron microscopy image of a cross section of a metal film deposited using liquid temperature control.

While it is true that grain size can be specified by controlling liquid temperature, other characteristics of the deposit produced with temperature control are undesirable. Specifically, the macroscopic quality of the deposits, evidenced through cross-sectional scanning electron microscopy, show significant shortcomings. FIG. 4 displays the cross-section of a deposit with a specified grain size and composition deposited under bath temperature control with direct current.

This deposit is not as homogeneous as can reasonably be desired (which will be explained below, in connection with deposits made according to an invention hereof) and includes cracks 402 and voids 404.

In addition to this poor homogeneity, bath temperature control suffers from additional undesirable problems. Changing bath temperature during a deposit is time consuming and highly energy consuming in large systems. Thus, it is not possible to change grain size and composition without significant difficulty, either during a single deposition run or from one run to the next run. Thus, it is difficult to achieve a microstructure that is graded or layered with respect to grain size within a single deposit.

It is typically easier to maintain a constant liquid temperature, than to change liquid temperature. Thus, a control method that requires changing the liquid temperature has undesirable complexity and costs associated therewith. Rather than, or in addition to liquid temperature control, deposit composition and grain size can conventionally be changed by changing the liquid composition. However, doing so also prohibits producing sequential, differently composed deposits without chemical alterations to the liquid, again, an added complexity. Changing the liquid composition, and/or its temperature necessarily results in system idle times. These idle times add cost to the process. Results using composition control are about the same as those using temperature control.

Thus, a difficulty with electrodepositing nanocrystalline deposits using either DC plating or UPP, is that it is not possible to obtain deposits having grain size within limits as precisely as may be desired. Changing the temperature or the composition of the bath is cumbersome. Moreover, it is not possible to produce a deposit having a nano-structure that varies through its thickness, especially if cracks and voids are to be avoided. Similarly, it is not possible to obtain deposits having composition as precisely as may be desired. Typically, control of the composition is largely dependent upon the composition of the liquid and its temperature, with no, or very little opportunity to adjust composition of the deposit once the composition of the liquid is established, other than by changing its temperature.

In addition to bath temperature and bath composition control, current density can also sometimes be used to control composition and grain size of alloy deposits. While this method can be used to control grain size (and also composition) it is inherently limited by the range of current densities that can be used while still achieving a homogeneous, crack and void free deposit of sufficient thickness. A high current density will result in highly stressed, cracked and voided deposits while a low current density will result in a slow deposition rate. Thus the range of grain sizes that can be achieved by this method are limited to a degree that makes it operationally unpractical.

Objects

Therefore, there is a need for a method of producing metal objects having nanocrystalline grain size structure, with the ability to tailor either the composition of the deposit, or its grain size, or both, without changing either the composition of the liquid or the temperature of the liquid. Further, there is a need for a method of producing such metal objects that produces high quality homogeneous deposits with a lesser degree of voids and cracks than is conventionally achieved using temperature control. There is also a need for a method that enables grading and layering of nanocrystalline crystal size and/or composition within a deposit, and further to do so without also introducing voids and cracks. A related need is to enable changing the composition and/or grain size of the deposit relatively quickly in time, so as not to otherwise disrupt the deposition process. Additional need exists for a method that is economical, scalable to industrial volumes and robust.

Detailed Discussion

An invention disclosed herein is to use the shape of the applied current waveform to control the grain size and composition of a deposit.

By introducing a bipolar wave current, for instance a square wave with both positive and negative current portions, the nanocrystalline grain size can be precisely controlled in particular electrodeposited alloys of two or more chemical components. Along with this precise control, the deposited metal also exhibits superior macroscopic quality, necessary for most practical applications of the material.

An invention hereof is to use bipolar pulsed current (BPP). With BPP, shown schematically in FIG. 5, current is pulsed with a positive current 5P segment, alternated with a negative current 5N segment, where the potential is momentarily inverted so that the element 340, which is a nominal cathode when current is positive, becomes an anode and vice versa. The opposite occurs with the electrode 342, which is a nominal anode during positive current, and a cathode during negative current. There need be no extended "off-time," (current of zero) although, there may be a momentary "off-time", and, more importantly, there is a definite period of negative current. Typically, the characteristic pulse times $t_{pos}$, $t_{neg}$ are on the order of 0.1-100 millisecond. There could also be a definite and measurable off-time of zero current, for instance using a pulse that has a positive period, a zero period and a negative period, and the positive or zero again.

The presence of a negative current during $t_{neg}$ has several important effects. For electrodeposition of pure metals, employing a negative current effectively levels the deposit over its surface area, due to a locally intense current density at high points in the deposit's cross-sectional profile. In the case of binary or higher alloys, however, the situation is more complicated. During the negative portion of the pulse, typically the atoms with the highest oxidation potential (lowest reduction potential) of the alloy, will be selectively etched (dissolved) from the deposit. This selective etching occurs regarding the most electro-active element, whether it is metal or not. This selective dissolution allows for precise control (within useful limits) of composition of the deposit with respect to the electro-active element. Other things being kept equal, as the absolute value of the amplitude of the negative pulse current increases, there is a resulting decrease in the proportion in the deposit of the more electro-active element.

The inventors have determined that a ratio Q of two components of the exciting waveform can be used to control composition of the deposit, and thus its grain size. These components are the absolute value of the time integrated amplitude of negative polarity current ($I^-$), and the absolute value of time integrated amplitude of positive polarity current ($I^+$), where:

$$N = \left|\int I^-(t)dt\right| \quad \text{Eq. 1}$$

$$P = \left|\int I^+(t)dt\right| \quad \text{Eq. 2}$$

and $$Q = \frac{N}{P}, \quad \text{Eq. 3}$$

where t is time, and the integrals in Eq. 1 and Eq. 2, run over all periods of negative and positive current, respectively. As used herein in the specification and the claims, the quantity Q is called the Polarity Ratio. The Polarity Ratio is always positive, because it is defined in terms of the absolute values of the amplitudes of the pulse components. In general, the Polarity Ratio will be greater than zero, and less than 1, for reasons discussed below.

In the most general case, control of the grain size of a deposition of a metallic object requires a few things. An electrodeposition system must co-deposit two or more elements simultaneously, at least one of which is a metallic element. The metallic element may, but need not be the most electro-active element. The grain size of single metal systems cannot be controlled using a method of the present invention.

The value of the Polarity Ratio can be varied by varying the amplitude and/or duration of both the positive and the negative pulses, relative to each other.

Figure 6:
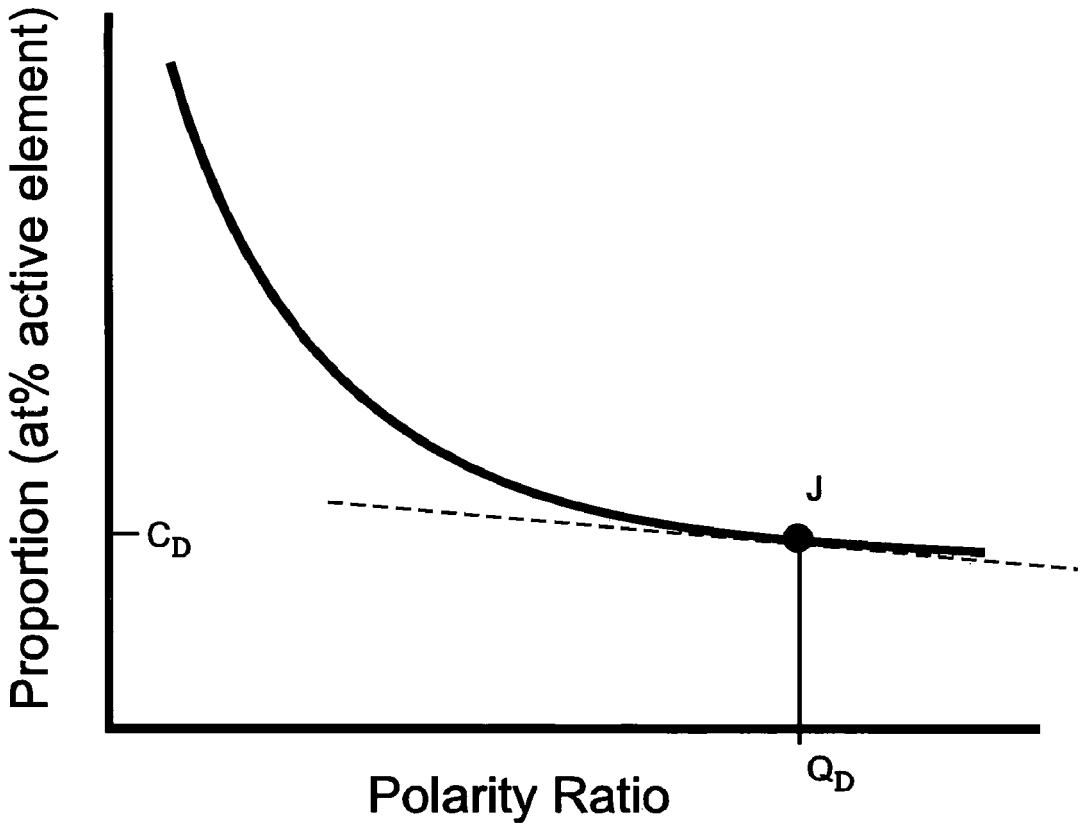
FIG. 6 is a graphical representation showing a generic relation of proportion of an element, shown on the vertical axis, as a function of Polarity Ratio, shown on a horizontal axis, having a negative varying slope, as it does for all relevant systems.

FIG. 6 is a graph showing schematically a generic relationship between the composition of a deposit, as characterized by the atomic % (at %) of the electro-active element (on the vertical scale) as a function of Polarity Ratio (on the horizontal scale).

In this specification and in the claims hereof, the contribution of the electro-active element to the composition will be referred to as the proportion of the electro-active element. The proportion can be measured in any appropriate way, including but not limited to: parts, weight percent, atomic percent, weight fractions, atomic fractions, volume percent or volume fraction, or any appropriate division.

Figure 7:
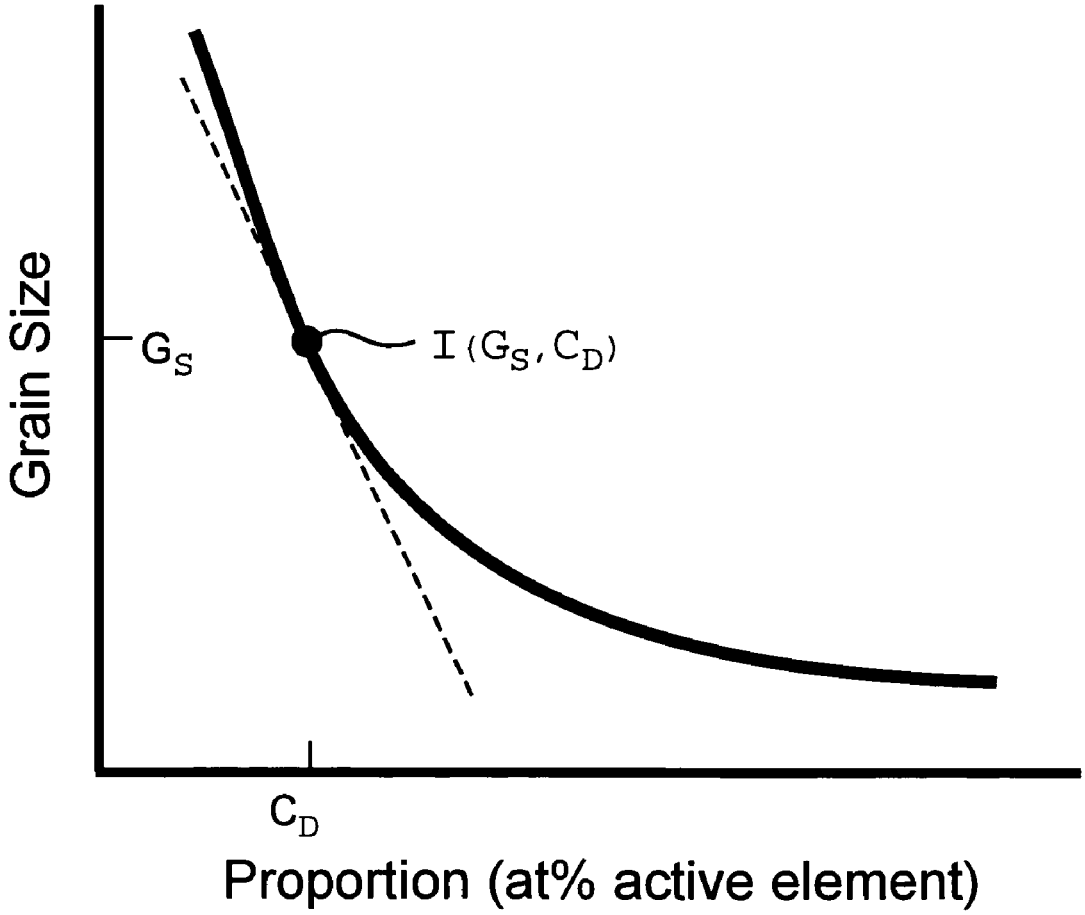
FIG. 7 is a graphical representation showing grain size of a deposit on the vertical scale, as a function of the proportion of an element, having a generally negative, varying slope.

In some alloy systems, there is a clear relationship between electro-deposit composition, as characterized by proportion of electro-active element, and grain size. For instance, as shown in FIG. 7, as the proportion of the electro-active element increases, the grain size decreases. But, in general, a relatively larger proportion of the electro-active element could result in either a relative smaller grain size, or relatively larger grain size (as shown schematically in FIG. 8, discussed below).

In general, this disclosure discussion is based on generic, or representative graphical representations of the relationships among parameters. For instance, FIGS. 6, 7, 8, 11, 16 represent generic relations. Several figures are based on experimental work by the inventors, typically with the Ni—W system, for instance, FIGS. 9, 10, 14, 15.

FIG. 7 shows grain size along the vertical axis as a function of proportion of the electro-active element, by atomic percent along the horizontal axis. The dependence of grain size upon proportion relations are based on the thermodynamics of grain boundary segregation and are beyond the scope of this disclosure. An important point is that grain size can be precisely controlled through careful adjustment to the composition in general, and in particular, of the proportion of the electro-active element. A reasonably full explanation is given in Weissmuller, J., *Alloy effects in nanostructures*, Nanostructured Materials, 1993, 3, p. 261-72, the disclosure of which is fully incorporated herein by reference.

Thus, FIG. 7 shows schematically that proportion of electro-active element can be used to control deposit grain size, analogously to the fact that bath temperature can be used to control grain size, as is understood with reference to FIG. 1.

Because, as discussed above, there is also generally a dependence of proportion of electro-active element upon Polarity Ratio, it is an invention hereof to use BPP in electrodeposition of alloys, to precisely control Polarity Ratio and thus, composition, with respect to electro-active element proportion, and by controlling composition, thereby to robustly control nanocrystalline grain size.

EXAMPLE

Using BPP to control crystal grain size in the nano-meter range has been reduced to practice, for instance for the particular case of a binary alloy of nickel-tungsten. This alloy was deposited with the liquid bath composition and plating parameters as given in Table 1, using an inert platinum electrode 342, nominally designated an anode and a copper electrode 340, nominally designated a cathode, in a 2 liter bath, as shown schematically with reference to FIG. 3. A pulsed current was used, having a negative current portion, the amplitude of which was varied for different specimen runs from 0 to negative 0.3 A/cm$^2$ at a constant pulse time of 3 ms. The positive portion of the pulse always had an amplitude of +0.2 A/cm$^2$, and a duration of 20 ms.

TABLE 1

| Deposition conditions for nickel-tungsten | |
|---|---|
| Nickel sulfate hexahydrate ($NiSO_4 \cdot 6H_2O$) | 0•06 M |
| Sodium tungstate hexahydrate ($Na_2WO_4 \cdot 2H_2O$) | 0•14 M |
| Sodium citrate dihydrate ($Na_3C_6H_5O_7 \cdot 2H_2O$) | 0•5 M |
| Ammonium chloride ($NH_4Cl$) | 0•5 M |
| Positive pulse time (ms) | 20 |
| Negative pulse time (ms) | 3 |
| Positive current density (A/cm$^2$) | 0•2 |
| Negative current density (A/cm$^2$) | 0-0•3 |
| Polarity Ratio | 0-0•225 |
| Bath temperature (° C•) | 75 |

Figure 9:
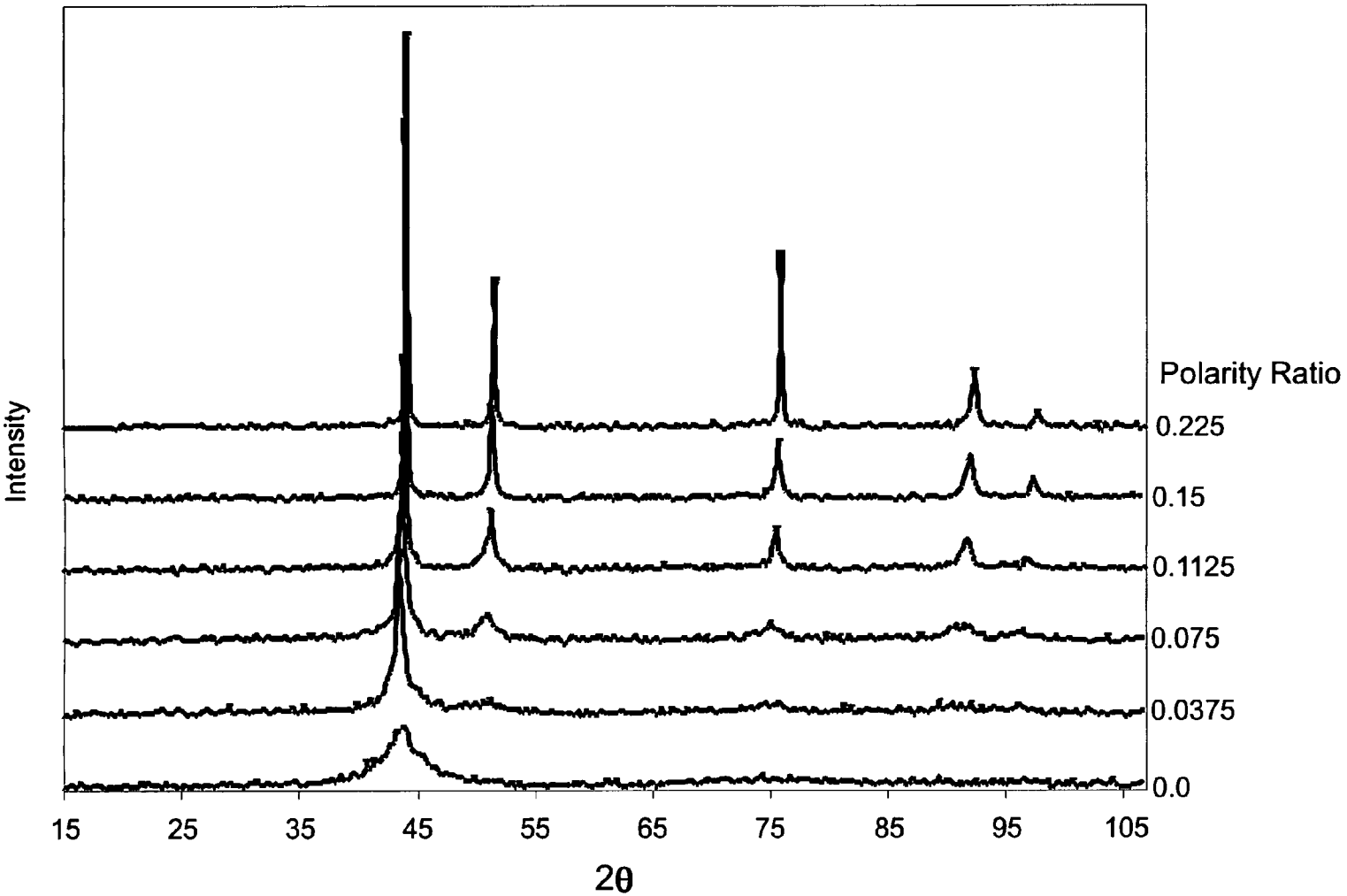
FIG. 9 is a graphical rendition of X-ray diffraction patterns for increasing values of Polarity Ratio for elecro-deposits of the Ni—W system.

FIG. 9 displays the x-ray diffraction patterns for specimens from different runs. Each run was conducted using a different Polarity Ratio, between 0 and 0.225, while keeping other factors constant. These diffraction patterns indicate a clear structural change, as a function of the Polarity Ratio, which in this case was adjusted from run to run by changing the absolute value of the amplitude of the negative pulse current. Furthermore, this data can be analyzed with standard methods to determine the grain size of the deposits.

Figure 10:
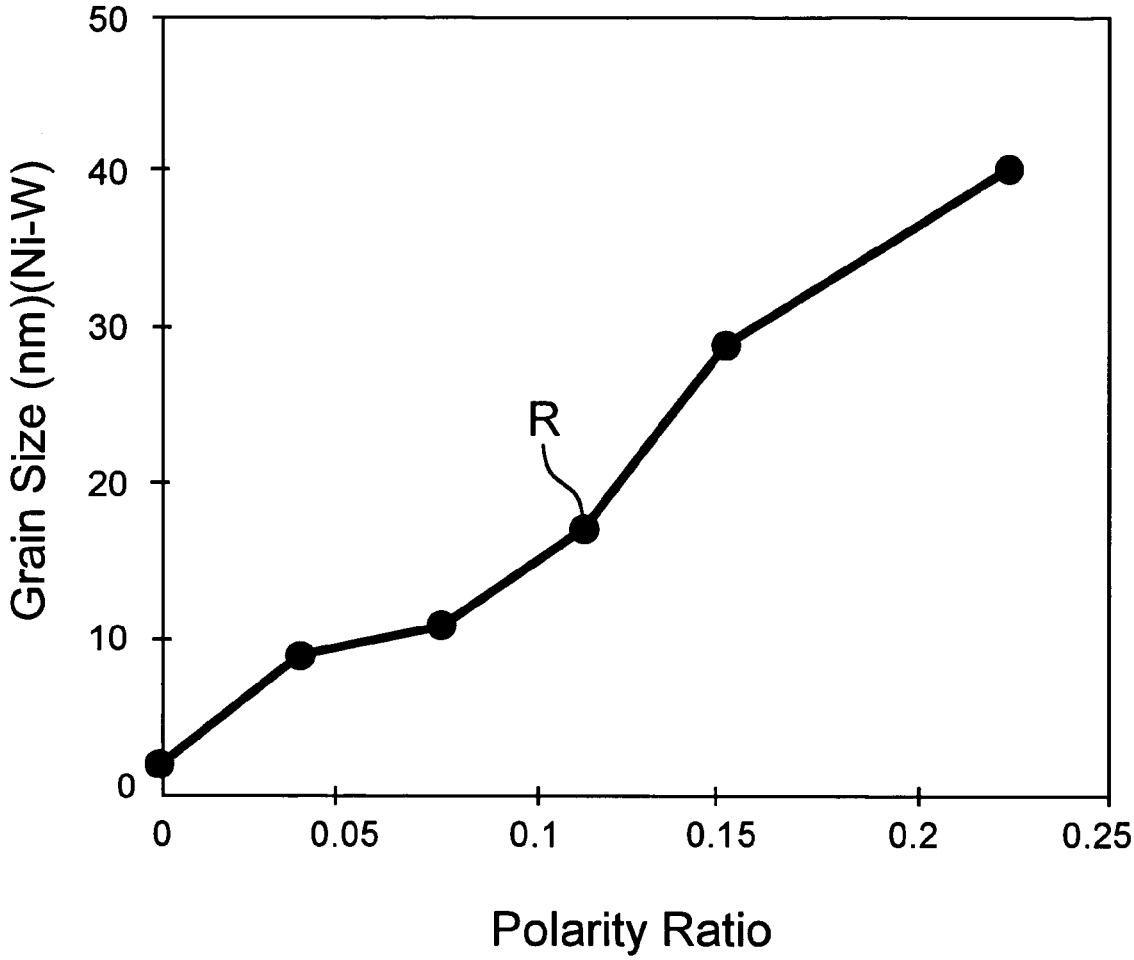
FIG. 10 is a graphical representation showing grain size on the vertical axis as a function of Polarity Ratio on the horizontal axis for a Ni—W system.

The results of such an analysis are shown in FIG. 10 with grain size shown on the vertical axis and Polarity Ratio shown on the horizontal axis. A change in the magnitude of the value of the Polarity Ratio produces a repeatable and significant change in the grain size. In general, for the Ni—W system, the slope ($\Delta G/\Delta N$) relating change in grain size ($\Delta G$) to change in Polarity Ratio ($\Delta N$) is positive, such that for relatively larger Polarity Ratio, the grain size will be relatively larger. From Eq. 3, recall that Polarity Ratio is the ratio of time integrated negative pulse amount divided by time integrated positive pulse amount. Thus, a relatively larger Polarity Ratio results from a relative increase in negative polarity current as compared to positive polarity current.

Figure 11:
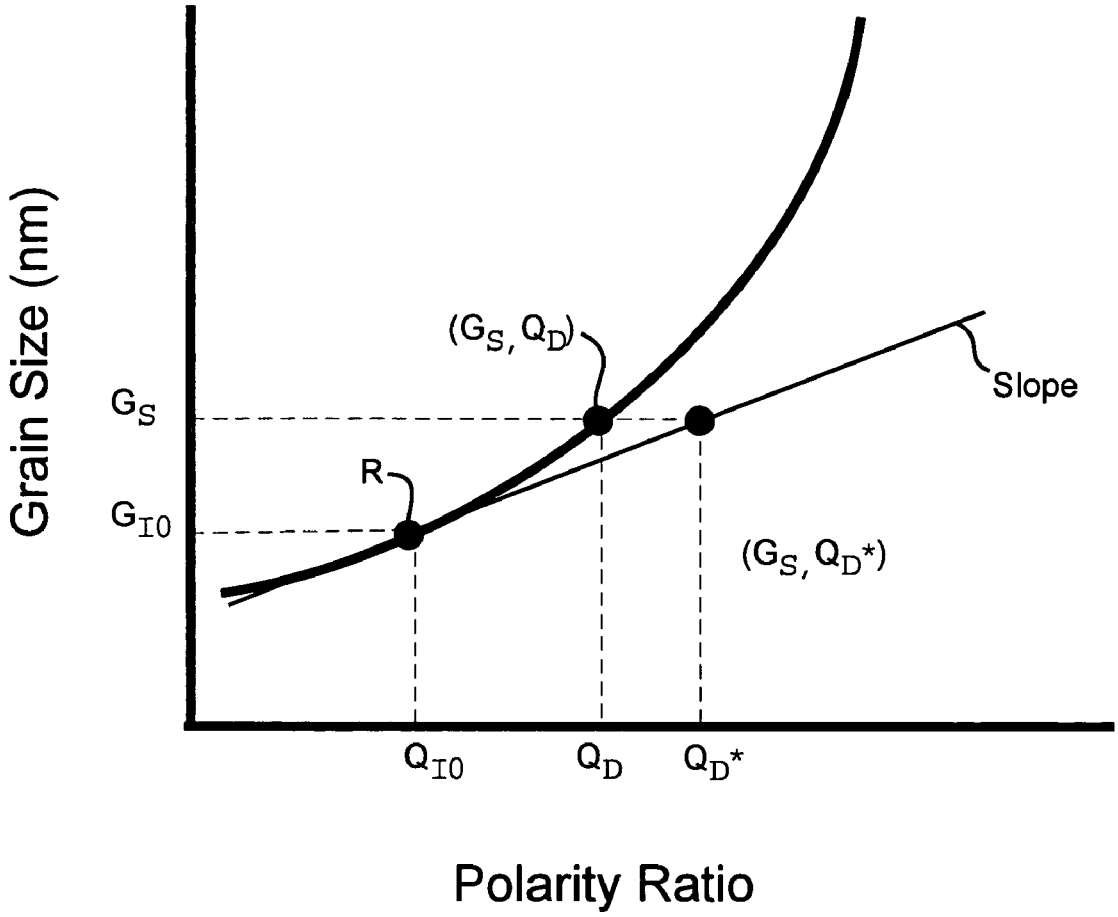
FIG. 11 is a graphical representation of a generic relation showing grain size on a vertical axis as a function of Polarity Ratio on a horizontal axis, having a generally positive slope of varying degree.

For the conditions studied, nanocrystalline structures with grain sizes ranging from 2-40 nm have been explicitly made. FIG. 11 shows a representative relation showing grain size as a function of Polarity Ratio for a generic system, having a generally positive and varying slope. The general relation shown in FIG. 11 results from combining a relationship of deposit grain size as a function of proportion electro-active element such as is shown in FIG. 7 with one of proportion electro-active element as a function of Polarity Ratio, such as is shown in FIG. 6.

Thus, to consider one way that an electrodeposition system might be designed, a designer would first specify an average grain size to meet mechanical or other property needs, such as $G_S$. Then, using a constitutive relation that relates grain size as a function of proportion, such as that shown in FIG. 7, would identify a point I on the curve of the constitutive relation that has $G_S$ as its grain size coordinate and from that point, identify a proportion $C_D$ of electro-active element, the proportion coordinate of point I, to achieve the specified grain size $G_S$. The designer would then refer to a constitutive relation showing proportion of the electro-active element as a function of Polarity Ratio, such as shown at FIG. 6, finding the Polarity Ratio $Q_D$ that would result in the chosen proportion. The point J on the curve shown in FIG. 6 relates the proportion $C_D$ to a Polarity Ratio $Q_D$. Running the system at this Polarity Ratio $Q_D$ would then achieve the determined proportion of electro-active element in the deposit $C_D$, and thus the specified grain size $G_S$. The subscript D for proportion C and Polarity Ratio Q is chosen because these quantities are essentially derived quantities, from a constitutive relation.

It is also possible to combine the two constitutive relationships shown in FIGS. 6 and 7 together to produce a single, composite constitutive relationship, such as is shown in FIG. 11, relating deposit grain size directly as a function of Polarity Ratio. In such a case, the designer specifies a grain size $G_S$ and from the continuous constitutive relationship, a Polarity Ratio $Q_D$ is identified.

Any of the constitutive relations discussed above could be graphical as shown, or tabular, or mathematical or any other rule or method of illustrating the relationship, including for either or both relationships, a single point and slope information at that point. The slope may be explicitly set forth within the relation, or, may be implicitly understood by the system designer based on general principles regarding alloy thermodynamics and kinetics and other information. The slope information may even be as limited as a sign (+ or −) and intuition as to degree.

FIG. 11 which represents a generic system, also shows a constitutive relation that is a single point, such as indicated at R, and slope information (illustrated by the thin solid line, but could be a quantity) at that point. As shown in FIG. 10, which presents information for a Ni—W system, the slope at R is about 200 nm. (Note, FIG. 11 is intended to show two different situations: one, illustrated by the curve, shows a continuous function constitutive curved relationship; the other, represented by the point R and the slope line, indicate a linear constitutive relationship.)

The different degrees of resolution of the constitutive relations discussed above may have an effect upon the degree of control that the designer has in achieving the desired nanocrystalline grain size. In general, a more highly resolved constitutive relationship will provide more precise control, while less resolution (as, for example, when only one data point is available and intuition is used to predict the constitutive relation) will provide less, and the least continuous, for instance a single point and a slope, or merely intuition about the sign of a slope, will provide the least amount of control. For some applications, precise control will be required, and a more continuous resolved relationship will be required. For other applications, less precise control will be required, and a less continuous constitutive relationship may be satisfactory. As is discussed below, for most systems, tighter control is generally possible for smaller grain size deposits.

Once a general constitutive relationship of grain size as a function of Polarity Ratio has been established, then to achieve a different grain size, the designer must change Polarity Ratio in the direction indicated by the relationship to change the grain size. This can be done by changing the amplitude or the duration of the negative portions of the pulse relative to that of the positive portions, or both as discussed below.

If either of the constitutive relations can be expressed by a continuous function, then the concept of an index parameter is relatively unnecessary, or simplified. The designer simply selects the Polarity Ratio, based on the specified grain size, if a composite relation is available, or, if not then the proportion of electro-active element, and, from that, the Polarity Ratio, in turn.

If either of the necessary relationships is not expressed in a continuous fashion, then the concept of index parameters may be helpful. For instance, in a case where a composite constitutive relation has been established expressing grain size as a function of Polarity Ratio, such as is shown with reference to FIG. 11, the designer specifies a desired grain size $G_S$, and from this grain size and the constitutive relationship, determines a Polarity Ratio. The Polarity Ratio is determined by comparing the specified grain size $G_S$ to an index grain size $G_{I0}$ for which a corresponding Polarity Ratio $Q_{I0}$ has already been explicitly established.

The slope information, embodied in the thin solid line identified as a slope, is applied to the corresponding Polarity Ratio $Q_{IO}$ to derive the Polarity Ratio $Q_{D*}$, that corresponds to $G_S$. If some other rule for filling in the constitutive relationship other than a slope is provided, such as a rule, or a set of points (which can be used for curve fitting or other interpolation), or intuition, then that is applied to the Polarity Ratio that corresponds to the index grain size $G_{I0}$. Note that the derived Polarity Ratio $Q_{D*}$ might turn out to differ from a Polarity Ratio $Q_D$ that might be determined from a relationship that can be expressed as a continuous curve. The discrepancy will depend on the degree to which the slope information conforms to an actual continuous relation.

Similarly, if rather than a composite constitutive relationship relating grain size as a function of Polarity Ratio, the designer uses two constitutive relationships: one relating grain size as a function of proportion of electro-active element such as shown with reference to FIG. 7, and the second relating proportion of electro-active element as a function of Polarity Ratio, as shown with reference to FIG. 6, and one or both of these are not expressed as a continuous function, then two similar operations are conducted. These are not fully illustrated, in the interest of preserving clarity in the graphs. However, the concept is identical to the technique illustrated with respect to the composite relation shown with reference to FIG. 11.

First, from specified grain size $G_S$, a proportion $C_{D*}$ of electro-active element is determined. The proportion is determined by comparing the specified grain size $G_S$ to an index grain size $G_{I0}$ for which a corresponding proportion $C_D$ of electro-active element has already been explicitly established. The slope information is applied to the corresponding proportion $C_D$ to arrive at a determined proportion $C_{D*}$. If some other rule for filling in the constitutive relationship other than slope information is provided, such as a rule, or a set of points (which can be used for curve fitting or other interpolation), or intuition, then that is applied to the proportion $C_D$ that corresponds to the index grain size $G_{I0}$ to arrive at $C_{D*}$.

Second, from the intermediately determined proportion $C_{D*}$, a Polarity Ratio is determined by comparing the intermediately determined proportion to an index proportion $C_{I1}$ for which a corresponding Polarity Ratio $P_D$ has already been explicitly established. The slope is applied to the corresponding Polarity Ratio $P_D$ to arrive at a derived Polarity Ratio $P_{D*}$. If some other rule for filling in the constitutive relationship other than a slope is provided, such as a rule, or a set of points (which can be used for curve fitting or other interpolation), or intuition, then that is applied to the Polarity Ratio that corresponds to the index proportion $P_D$.

The foregoing describes how the designer designs the system. The method of using the designed system and electrodepositing works as follows. The system is driven by the power supply to provide periods of both a positive current and a negative current at different times as specified by the system designer, which corresponds to a specific, single Polarity Ratio. This in turn results in a specific, deposit composition, which has a proportion of the electro-active element that will achieve the specified grain size. Thus, the specified grain size is achieved. Thus, to design a system, a constitutive relation is required, relating grain size to Polarity Ratio. To run the system, only a single point, relating a single average grain size to a single Polarity Ratio is required, or used.

Not only is grain size controllable through BPP, but the macroscopic quality of these deposits is significantly better than that achieved by other processing means. As previously mentioned, the grain size of a multi-component electro-deposit can be controlled by precise control of bath temperature, according to known techniques, illustrated in FIG. 1.

Figure 12:
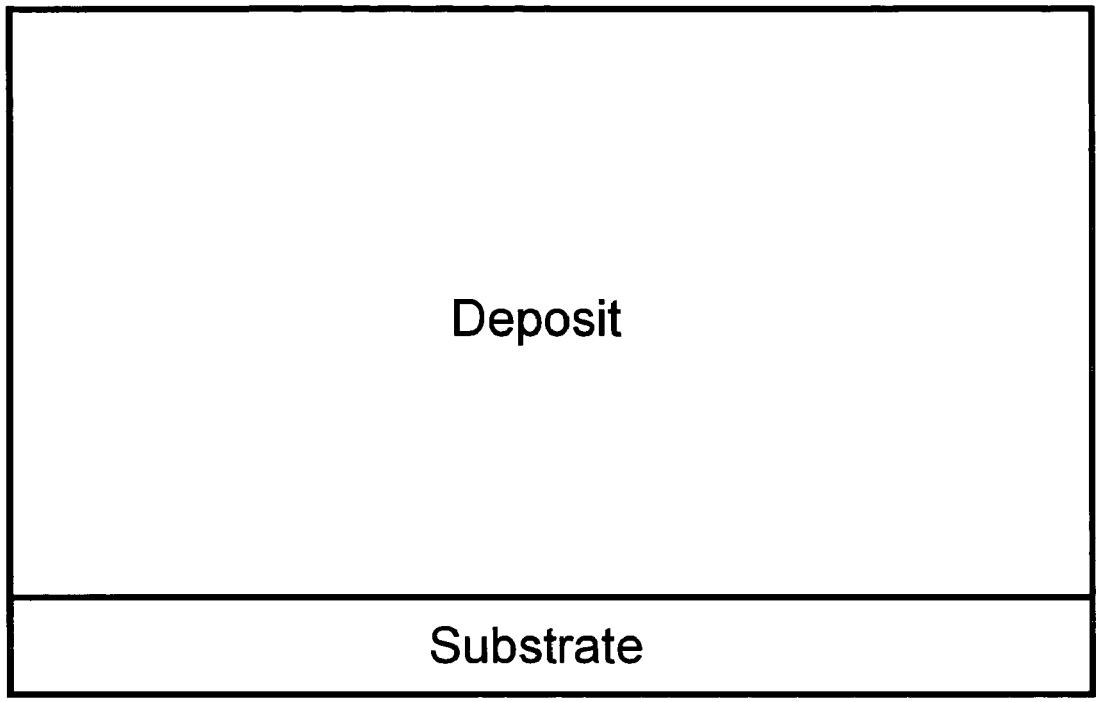
FIG. 12 is a schematic rendition of a scanning electron microscopy image of a cross section of a metal film deposited by BPP control of a method invention hereof.

The macroscopic quality of the deposits, manifested through cross-sectional scanning electron microscopy, is significantly better for the BPP samples. FIG. 12 schematically shows such an electron microscopy scan, and displays the cross-sections of a deposit that was deposited using a method of an invention hereof of bipolar pulsing. It has nearly identical grain size and composition to that shown in FIG. 4, discussed above, which was deposited under bath temperature control with direct current.

In general, using negative current pulsing as disclosed herein enables fabricating objects having nanocrystalline grain structures that are substantially free of cracks and voids. By substantially free of voids, or cracks, it is meant that neither voids nor cracks, respectively, created during the deposition, dominate the fracture, wear or corrosion properties of the nanocrystalline body. The failure modes of the article are dominated by phenomena other than crack initiation and propagation from pre-existing voids, or pre-existing cracks.

Additional properties that nanocrystalline grain structure affects are corrosion resistance and wear resistance. Both of these factors are directly related to grain size, in general, typically, with smaller grain size providing better resistance to wear. In some alloy systems such as passivating alloys, smaller grain size also provides better resistance to corrosion. Thus, BPP can be used to tailor the grain size and structure to achieve a desired degree of wear resistance or a desired degree of corrosion resistance.

Negative current pulsing clearly produces a more homogeneous deposit, without cracks 402 or voids 404.

Figure 13:
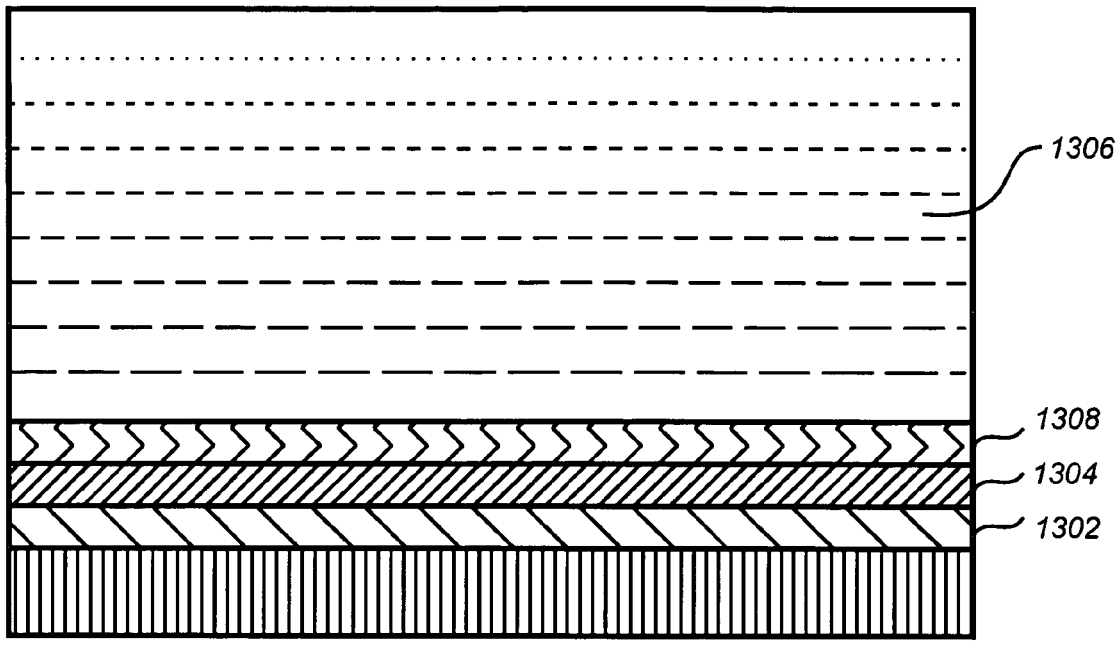
FIG. 13 is a schematic rendition of a cross-section of a deposit made according to a method of an invention hereof, having adjacent layers with different average grain size, and a larger layer having a graded average grain size through its thickness.

In addition to this quality improvement, negative current pulsing offers additional advantages over other methods. The current density of the negative pulse can easily be varied at the power source at any time during deposition, and thus at any spatial location throughout the thickness of the deposit. This makes it possible to create graded microstructures, where grain size is controlled throughout the deposit thickness. Bipolar pulsing allows for microstructure control with a constant bath temperature, thereby avoiding the time and energy consumption to change bath temperature. Similarly, as shown in FIG. 13, layered structures in which layers 1302 of one grain size alternate with a second layer 1304 of a second, different grain size are possible. The difference in grain size between adjacent layers can be anything from barely noticeable (plus or minus 1 nanometer) to as large as fifty nanometers or larger. Moreover, regions of different grain size can be continuously graded, as at 1306, rather than discrete or abrupt, as at 1308. Those concepts apply also to any combinations of layered and graded deposits including uniform, alternating, laminate structures, irregular patterns of grain size variation through the deposit thickness, and deposits with both smoothly graded and layered components. Using bipolar pulsing, sequential deposits upon different electrodes can be produced in the same liquid with generally increasing or decreasing grain size requirements throughout the thickness (and even reversals thereof) without a need for chemical additions to the bath. Bipolar pulsing simplifies the electrodeposition process by requiring one liquid composition at a single temperature for all desired microstructures. This advantage will save time and money in any industrial scale operation where bath temperature and composition changes create costly down-time.

Because there is a direct relationship between composition and grain size of the deposit, all that has been said above about varying grain size throughout the thickness of a deposit also applies to composition. Thus, if composition, rather than grain size, is of paramount interest to a designer, then an object can be made with a specifically tailored compositional gradient, or layer structure.

As has been mentioned above the magnetic properties of nanocrystalline metals show a higher combination of permeability and saturation magnetic flux density than possible in traditional microcrystalline metals. These properties are important for soft magnetic applications and are enhanced as grain size is decreased to the nano-scale. Using bipolar pulsing, such a nanostructured alloy can be produced to exploit these properties. Bipolar pulsing may also be used to put a biocompatible coating of desired structure and properties on a conductive body.

Commercial Applications

The disclosed method of bipolar pulsing to achieve grain size control can be used in any existing electroplating industry, with the addition of a power source equipped with positive and negative current capability and the ability to reverse between positive and negative in a controlled manner. As outlined in the previous section, BPP adds the ability to engineer electrodeposits having graded nanocrystalline sizes without complications, as compared to current methods for crystal size grading. For example, a deposit could have a relatively large (microcrystalline) grain size at a substrate interface, with a grain size that could be continuously reduced to the single nanometer scale at a surface and even to extremely small sizes of two nanometers or less. This type of coating would provide the superior wear and corrosion resistance of a nanometer scale crystalline coating, with improved ductility and toughness beneath the surface as compared to a uniformly nanocrystalline deposit.

BPP also simplifies the electrodeposition process by reducing the need for costly and complicated liquid temperature and chemistry control. This would decrease the difficulty of forecasting costs due to variable chemical needs and would also increase the flexibility of the plating operation by allowing widely different microstructures and nano-structures to be deposited from the same liquid. In addition, the quality of deposits could be vastly improved in certain cases as evidenced by FIG. 12. This quality improvement will manifest itself in reduced post-deposition surface finishing requirements and improved erosion/corrosion resistance.

BPP has been reduced to practice in the Ni—W system. It is also widely applicable to other electrodeposited, multi-component systems that show a relationship between composition and grain size, including but not limited to: nickel-molybdenum (Ni—Mo); nickel-phosphorous (Ni—P); nickel-tungsten-boron (Ni—W—B); iron-molybdenum (Fe—Mo); iron-phosphorous (Fe—P); cobalt-molybdenum (Co—Mo); cobalt-phosphorous (Co—P); cobalt-zinc (Co—Zn); iron-tungsten (Fe—W); copper-silver (Cu—Ag); cobalt-nickel-phosphorous (Co—Ni—P); cobalt-tungsten (Co—W); and chromium-phosphorous (Cr—P). This process will not only benefit coating applications, but also the production of thick, free-standing bulk size nanocrystalline structured components.

In general, the foregoing has illustrated changing the Polarity Ratio by changing the amplitude of the negative pulse component. It is also possible to change the Polarity Ratio to achieve similar results by changing the duration of the negative pulse ($t_{neg}$) relative to the duration of the positive pulse $t_{pos}$, instead of changing only the negative current density amplitude, as was done above. Further, both the duration and the amplitude can be changed. It is also possible to alter the shape of the positive and negative pulses, such that they are no longer square waves as illustrated schematically in FIG. 5. The important quantification of the negative pulsing is the Polarity Ratio.

Turning now to a closer look at the relation between Polarity Ratio and grain size of a deposit for various systems, the discussion below is of the Ni—W system. The slope of the composite relationship showing grain size as a function of Polarity Ratio is generally positive, as shown in FIG. 11: namely relatively larger Polarity Ratio, results in relatively larger grain size. FIG. 11 shows the relationships for a generic system that behaves similar to the Ni—W system. FIG. 10 shows data from a Ni—W system as described above in Table 1. The relationship describing grain size as a function of Polarity Ratio is itself a composite relationship, which depends on two other relationships for its nature: 1) the relationship describing proportion of electro-active material deposited as a function of Polarity Ratio; and 2) the relationship describing grain size as a function of proportion of electro-active material deposited.

Figure 14:
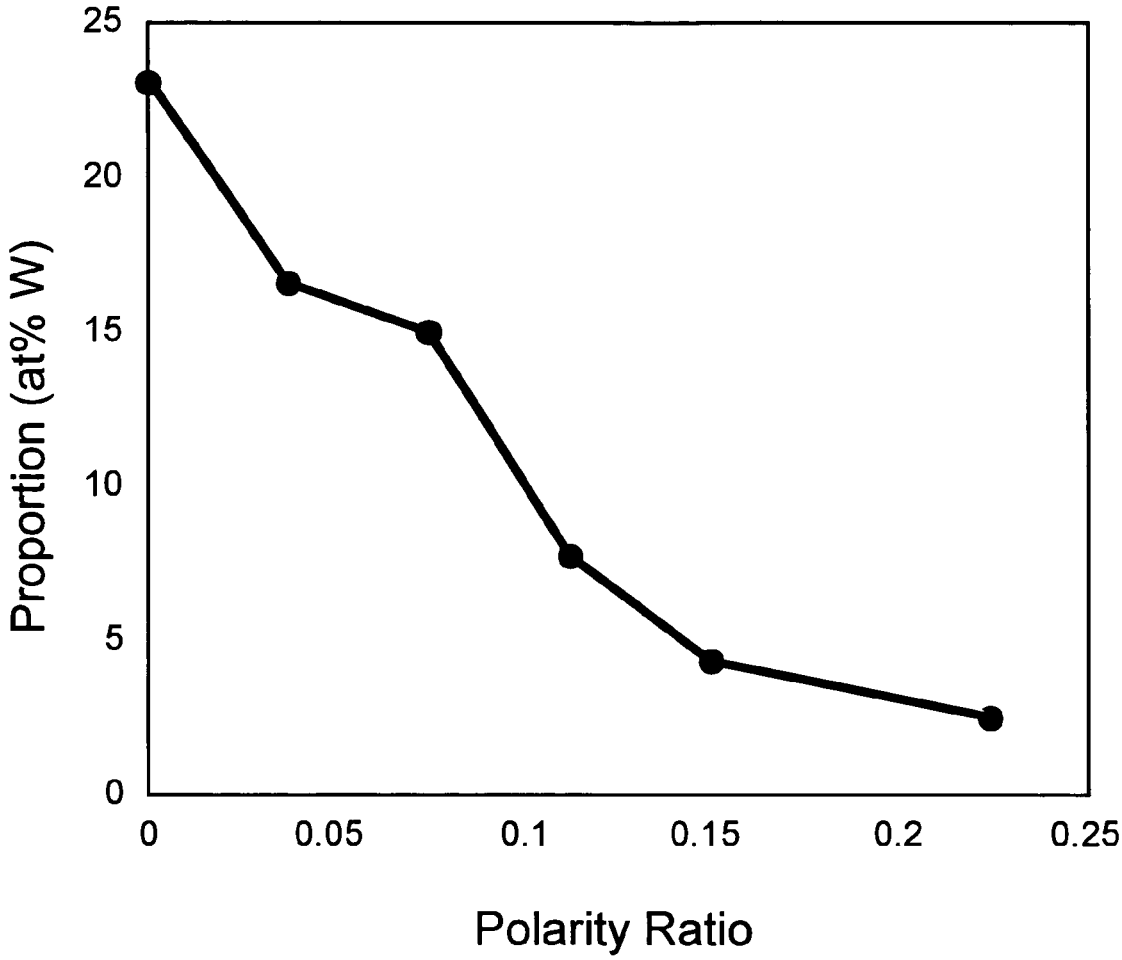
FIG. 14 is a graphical representation relating proportion of the electro-active element W on the vertical axis as a function of Polarity Ratio on the horizontal axis, for a Ni—W system.

For all systems, the relation describing proportion of deposited electro-active material as a function of Polarity Ratio is generally as shown in FIG. 6, with a generally negative slope, such that for relatively larger Polarity Ratio (and thus relative larger absolute value of negative current density, as compared to positive) the proportion of electro-active material in the deposit is relatively smaller. FIG. 14 shows this relationship for the Ni—W system as described above in Table 1.

In contrast, for different systems, the other characterizing relationship, describing grain size as a function of deposited proportion of electro-active material, can have either a positive or a negative slope. Thus, the sign of the slope of the relationship describing grain size as a function of Polarity Ratio, and its magnitude, depends on the sign and magnitude of the slope of the relationship describing grain size as a function of proportion of electro-active material for the system in question.

Figure 15:
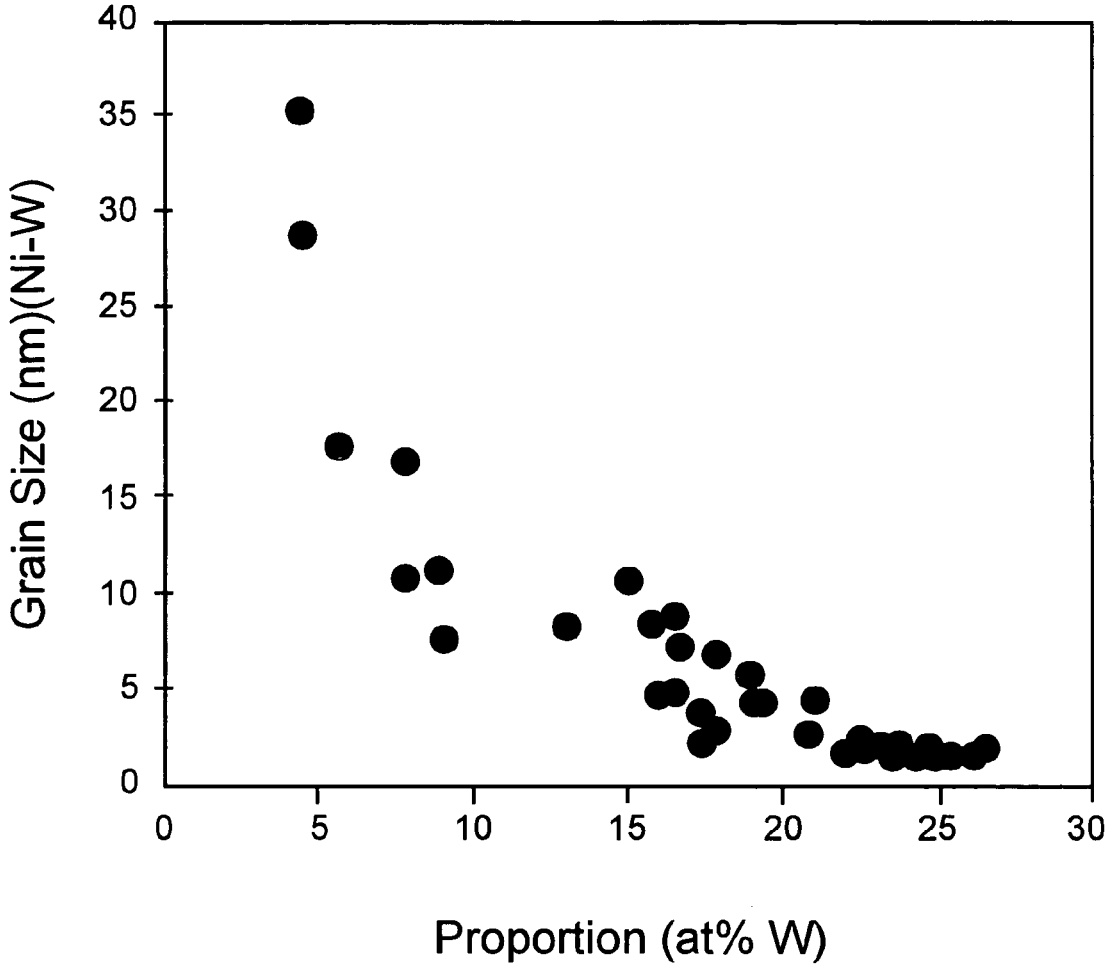
FIG. 15 is a graphical representation showing experimental data relating grain size as a function of proportion of W for a Ni—W system.

For the Ni—W system discussed above, the sign of the slope of this relationship as shown generally with reference to FIG. 7 and FIG. 15 is generally negative and varying. Thus, the slope of the composite relationship describing grain size as a function of Polarity Ratio is generally positive, as shown in FIG. 11.

Figure 8:
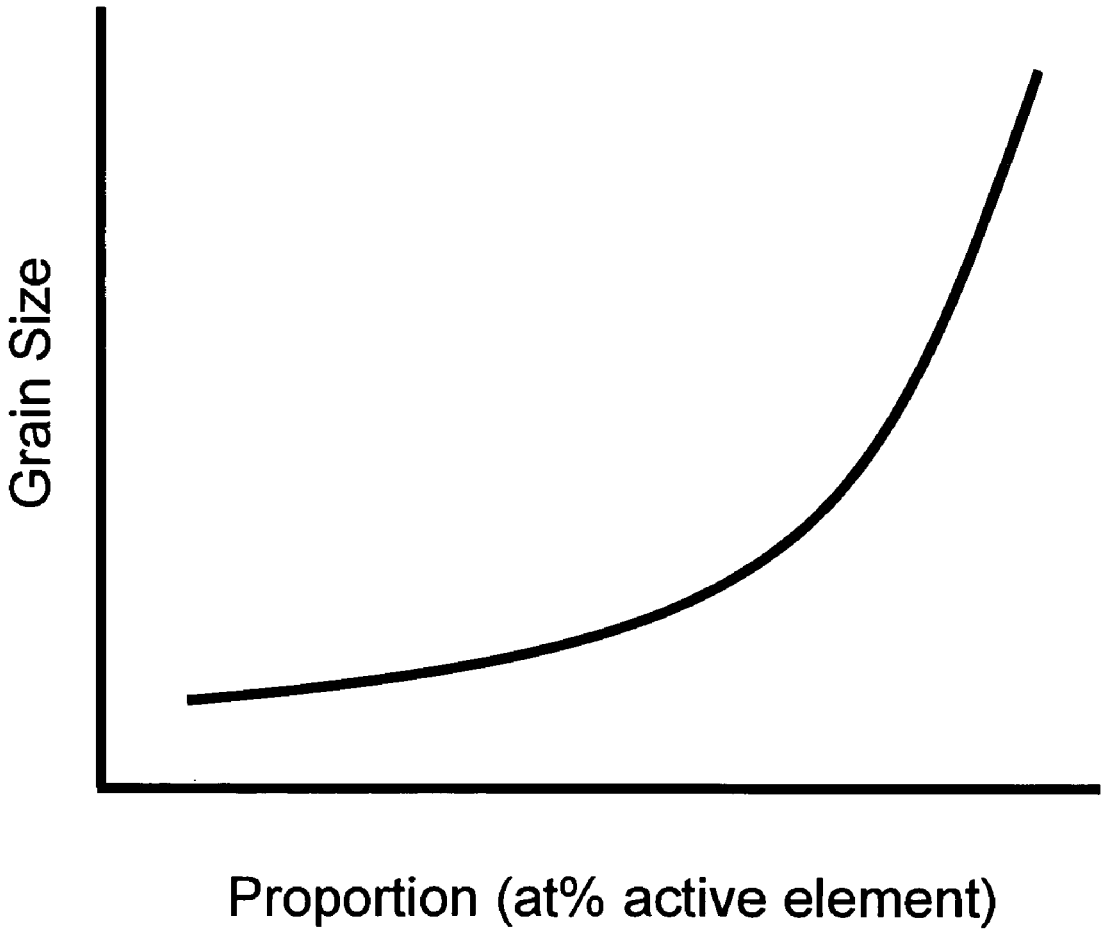
FIG. 8 is a graphical representation showing a generic relation of grain size on the vertical axis as a function of proportion of an electro-active element shown on the horizontal axis, having a generally positive, varying slope at all locations.
Figure 16:
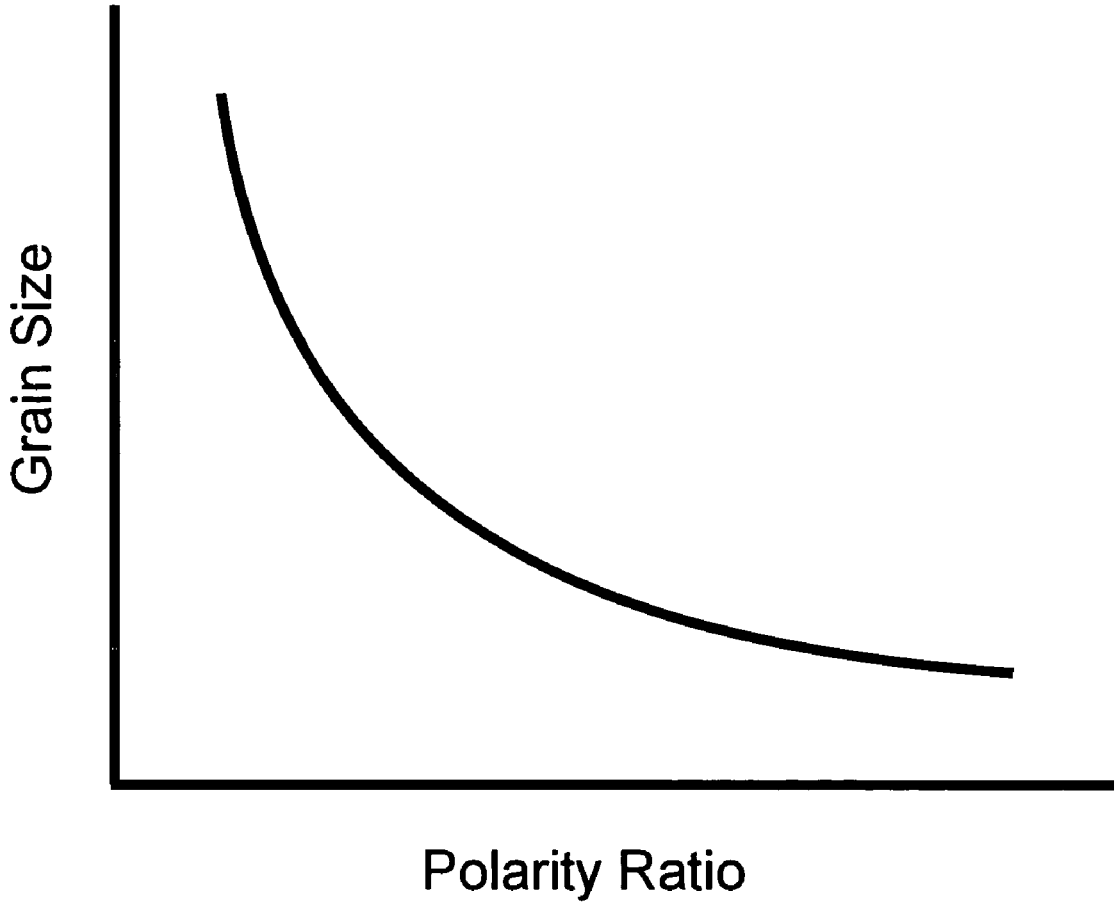
FIG. 16 is a graphical representation showing a generic relation of grain size on the vertical axis as a function of Polarity Ratio, on the horizontal axis, having a slope generally opposite to that shown in FIG. 10, such as would arise from a system having a grain size as a function of proportion relation, such as shown in FIG. 8, and a proportion as a function of Polarity Ratio relation, such as shown in FIG. 6.

There are also systems for which the sign of the slope of the relationship showing grain size as a function of proportion of electro-active material, as shown generally with reference to FIG. 8, is generally positive and varying. Thus, the slope of the composite relationship showing grain size as a function of Polarity Ratio is generally negative, as shown in FIG. 16. An example of such a system may be the Cu—Ag system.

At the time of this writing, there is not much knowledge regarding the general shape, and the slope in particular, of a characteristic curve or relation relating grain size as a function of proportion of electro-active element in a deposit, such as shown in FIG. 8, where the relationship has curvature, with a generally positive slope, or FIG. 7, where the relationship has curvature with a generally negative and varying slope. (Note that it may be that the curve approximates a straight line over the relevant range of grain sizes.)

However, as more work is done in this area, more such relations will become known. Once known, the general principals taught herein can be applied, and the relation can be combined with a relation showing proportion of electro-active element as a function of Polarity Ratio, such as shown at FIG. 6, to arrive at a composite relation showing grain size as a function of Polarity Ratio, such as shown in FIG. 11 (positive slope) or FIG. 16 (negative slope).

Variations

While the foregoing has discussed a specific binary system for Ni—W, including liquid chemistry and plating parameters, the extent of present inventions hereof are not limited in this respect. Multiple liquid chemistry variations and plating parameters can be used to electro-deposit binary alloys having a highly controlled nanocrystalline structure.

The liquid has been generally referred to above as a bath. The liquid need not be a stationary body of liquid in a closed vessel. The liquid can be flowing, such as through a conduit, or streaming through an atmosphere as in a jet, projected at an electrode. All of the discussions above regarding a bath can also apply to such a moving liquid composition. One or both electrodes can be a conduit through which or around which the fluid flows.

Inventions hereof also include other metal systems that can be electrodeposited with a controlled nanocrystalline structure. These systems need not be binary alloys, but also can be ternary and higher combinations of elements. Significant literature exists discussing crystalline metals (nanocrystalline and microcrystalline, both of which are relevant) that are electrodeposited from aqueous solutions. It is believed that techniques of inventions hereof can also be applied to such systems, including but not limited to: nickel-molybdenum (Ni—Mo); nickel-phosphorous (Ni—P); nickel-tungsten-boron (Ni—W—B); iron-molybdenum (Fe—Mo); iron-phosphorous (Fe—P); cobalt-molybdenum (Co—Mo); cobalt-phosphorous (Co—P); cobalt-zinc (Co—Zn); iron-tungsten (Fe—W); copper-silver (Cu—Ag); cobalt-nickel-phosphorous (Co—Ni—P); cobalt-tungsten (Co—W) and chromium-phosphorous (Cr—P). Other systems that can provide at least two metal salts in aqueous solutions are also possible.

Other types of solutions are possible, including but not limited to: non-aqueous, alcohol, HCl (liquid hydrogen chloride), and molten salt. If a molten salt bath is used, the operating temperature may be higher than for an aqueous bath.

Figure 5:
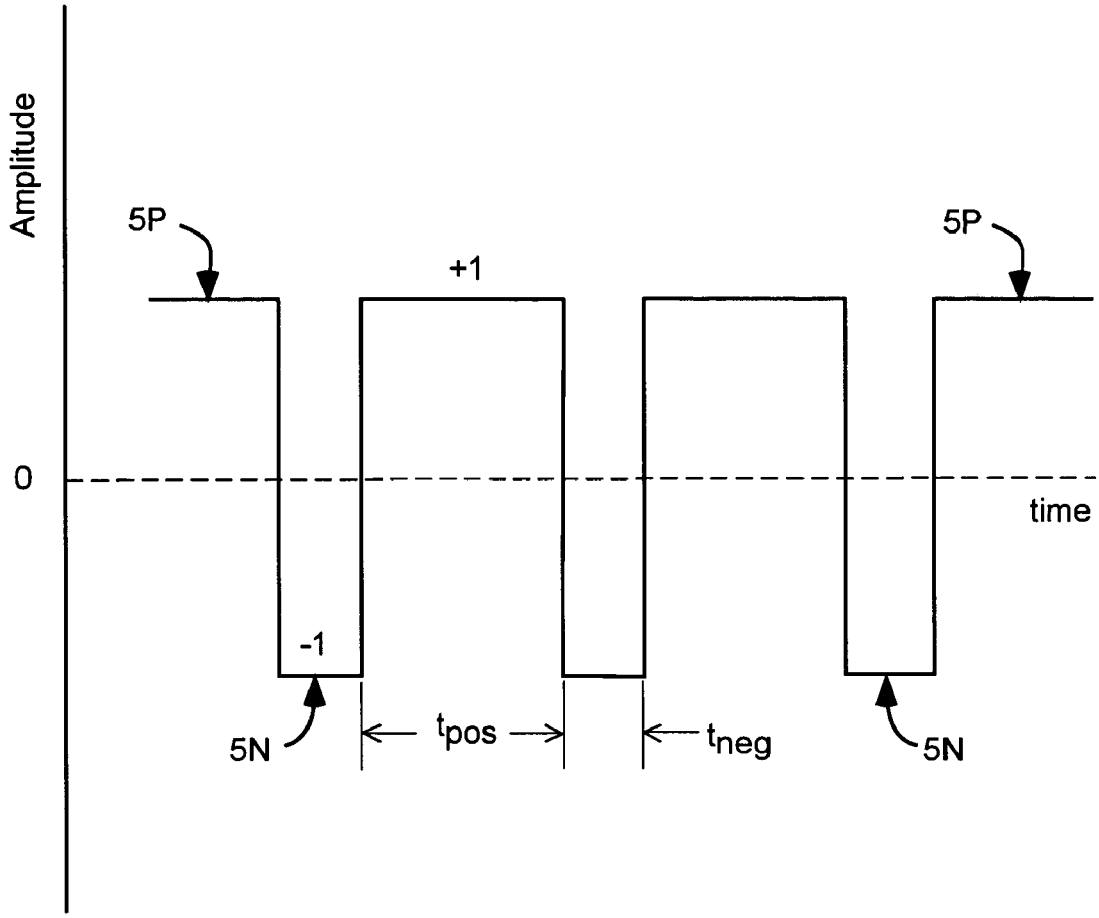
FIG. 5 is a schematic rendition of a bipolar pulsing (BPP) current waveform for use with a method of an invention hereof.

The shape shown for the waveform in FIG. 5 is generally a square wave. The wave need not be square. In general, it can be any shape that varies between positive and negative levels, as compared to an electrical ground (zero), including sine, cosine, saw tooth, etc. The Polarity Ratio is an important parameter during the deposition which must be greater than zero and less than 1. Its magnitude will govern the proportion of electro-active material in the deposit, which will, in turn, govern the grain size in the deposit.

Another important consideration is the behavior of a system that has more than two components. There will still be an element that is removed preferentially from the forming crystal structure under the influence of negative polarity applied current. Typically, this is the element with the highest oxidation potential. The element with the next highest oxidation potential will also be removed to some extent from the crystal, to an extent that depends on the details of the system, such as liquid composition and the differences in oxidation potential of the various components.

Much of the foregoing discusses deposits in terms of unitary deposits, or bulk deposits. A very useful application for inventions hereof is as coatings upon other substrates. For instance nanocrystalline metal deposits can be placed as coatings upon substrates for use in much the same way that hard chrome coatings are used, at the time of this writing. Such hard metal coating can be used to establish resistance to wear, abrasion and corrosion. Such coatings can be used to establish a desired surface property, such as, including but not limited to: lustre, reflectivity, color protection against oxidation, biocompatibility, etc.

Another commercial use for which inventions disclosed herein can be applied is for reworking or rebuilding machine tool components, and other components that need the same sort of rehabilitation. Such tools wear down during use, and become smaller in various dimensions. At some time, they become unfit for their intended use. They can be rebuilt to their original, or to suitable dimensions, by using the tool as an electrode substrate and electroplating metal upon the substrate to a degree that returns the substrate to a size and to dimensions that it can be used again for its original purpose, or, in some cases, for a similar related but different purpose. Basically, the electroplating operation increases the volume of the worn part to a degree that it achieves a desired geometry, or tolerance and becomes useful.

Coatings with nanocrystalline grain structures achieved according to methods of inventions hereof can be applied to a wide range of metal substrates, including, but not limited to: steel, stainless steel, aluminum, brass, and even to plastic substrates with electrically conductive surfaces.

Control of Processes

The degree of control available over grain size depends upon the system, and the selected grain size itself. In general, the designer and the operator of a process have more precise control for relatively smaller grain sizes. For both the case similar to Ni—W, where the relation defining grain size as a function of deposit proportion has a generally negative slope, as shown in FIG. 7, and the case with the opposite, positive slope, such as shown in FIG. 8, which is believed to describe a Ag—Cu or similar system, there is most possibility for the most precise use of the invention with relatively smaller grain sizes.

This is because, for both cases, typically, the magnitude of the slope is relatively lower for smaller grain sizes. (Stated equivalently, the magnitude of the first derivative of the function relating proportion of electro-active element to grain size is smaller (in absolute value) for smaller grain sizes. Taking for instance the negative slope case shown in FIG. 7, for relatively smaller grain size, change in grain size is relatively insensitive to a change in proportion of electro-active element, as compared to relatively larger grain size. Thus, the practitioner need not be as precise in achieving the target parameter of proportion electro-active element, but will still be very close to the desired grain size. For the case with the negative slope dependency, this region of tighter control occurs with generally higher proportion of electro-active element. In contrast, for lower proportions of electro-active element, the change in grain size is dramatic for a relatively small change in proportion.

For the case with the positive slope dependency, as shown with reference to FIG. 8, this region of tighter control occurs with generally lower proportion of electro-active element. In contrast, for higher proportions of electro-active element, the change in grain size is dramatic for a relatively small change in proportion. This difference in slope magnitude is present in the cases shown. However, there are some systems where this generalization does not hold, and the slope is generally constant from small to large grain sizes. In those cases, control is not dependent on grain size, and other factors may dominate a control issue.

The dependence of grain size upon proportion is only one part of the composite relationship showing grain size as a function of Polarity Ratio. However, the other part of that relationship, showing proportion of electro-active material as a function of Polarity Ratio, has its own region of better control, which will depend upon the shape and location of the curve. For instance, as shown in FIG. 6, the designer will have better control over the proportion of electro-active element at the lower ranges of the proportion scale, where the curve has a relatively smaller (absolute value) and more constant slope, as compared to the higher proportion ranges, where the slope is very largely negative.

Partial Summary

Inventions disclosed and described herein include methods of depositing a nanocrystalline alloy on a substrate, articles of manufacture incorporating such a deposited alloy, as well as methods for determining parameters of material selection and electrode voltage supply to achieve a desired grain size.

Thus, this document discloses many related inventions.

One invention disclosed herein is a method for depositing an alloy of a system comprising at least two elements, one of which being most electro-active and at least one of which being a metal. Such an alloy deposit has a specified nanocrystalline average grain size. The method comprises the steps of: providing a liquid comprising dissolved species of at least two elements of the system, at least one of which elements is the metal and at least one of which elements is the most electro-active; providing a first electrode and a second electrode in the liquid, coupled to a power supply configured to supply electrical potential having periods of positive polarity and negative polarity at different times; and driving the power supply to achieve the specified grain size deposit at the second electrode, with a non-constant electrical potential having positive polarity and negative polarity at different times, which times and polarities characterize a Polarity Ratio.

The step of driving the power supply may comprise driving the power supply to establish a Polarity Ratio that has been selected with reference to a constitutive relation that relates the specified electrodeposited grain size to a corresponding Polarity Ratio. The constitutive relation may also include slope information that relates change in grain size to change in Polarity Ratio.

According to one preferred embodiment, first for a case that the slope information indicates a positive slope at the index grain size: for a specified grain size i) relatively larger than an index grain size, a relatively larger Polarity Ratio is used than a Polarity Ratio corresponding to the index grain size; and ii) for a specified grain size relatively smaller than the index grain size, a Polarity Ratio is used that is relatively smaller than the Polarity Ratio corresponding to the index grain size. On the other hand, for a case that the slope information indicates a negative slope at the index grain size for a specified grain size i) relatively larger than the index grain size, a relatively smaller Polarity Ratio is used than the Polarity Ratio corresponding to the index grain size; and ii) for a specified grain size relatively smaller than the index grain size, a relatively larger Polarity Ratio is used than the Polarity Ratio corresponding to the index grain size. According to this embodiment, using a relatively smaller Polarity Ratio can comprise using relatively less time at negative polarity. Or, it may comprise using relatively lower absolute value amplitude negative polarity, or both. Similarly, the step of using a relatively larger Polarity Ratio may comprise using relatively more time at negative polarity. Or it may comprise using relatively higher absolute value amplitude negative polarity or both.

According to yet another set of related preferred embodiments, the step of driving the power supply may comprising driving the power supply to generate a sine wave, or a square wave.

With a related embodiment, the step of driving a power supply may comprise driving the power supply with a non-constant electrical potential, the Polarity Ratio supplied during deposition having been determined with reference to: a constitutive relation that relates the specified electrodeposited grain size to a corresponding proportion in the deposit of the active element; and a constitutive relation that relates the corresponding proportion in the deposit of the active element to a Polarity Ratio supplied during deposition.

According to one version of such an embodiment, the step of driving the power supply with a non-constant electrical potential is conducted where the Polarity Ratio supplied during deposition has been determined by: identifying a proportion of active element that corresponds to the specified grain size; and identifying a Polarity Ratio that corresponds to the identified proportion that corresponds to the specified electrodeposited grain size.

For one variation of such a method, the power supply is driven: to achieve an electro-deposit composition having a relatively lower proportion of the relatively most active element than the proportion of that element in an index composition, by using relatively greater Polarity Ratio than a Polarity Ratio that corresponds to that index composition based on the constitutive relation; and to achieve an electro-deposit composition having a relatively greater proportion of the relatively most active element than the proportion of that element in the index composition, by using relatively lower Polarity Ratio than a Polarity Ratio that corresponds to that index composition.

Still another embodiment of an invention hereof is a method for depositing an alloy of a system comprising at least two elements, one of which being most electro-active and at least one of which elements being a metal, an alloy deposit having a specified nanocrystalline average grain size. The method comprises the steps of: providing a liquid comprising dissolved species of the at least two elements at least one of which elements is the metal and at least one of which elements is the most electro-active; providing a first electrode and a second electrode in the liquid, coupled to a power supply configured to supply electrical potential having periods of positive polarity and negative polarity at different times; and driving the power supply to achieve the specified grain size deposit at the second electrode, with a non-constant electrical potential having periods of positive polarity and negative polarity at different times. The Polarity Ratio supplied during deposition will have been determined with reference to: a first constitutive relation that relates electrodeposited average grain size of a deposit to a proportion of the most electro-active metal in the deposit; and a second constitutive relation that relates the proportion of the most electro-active metal in a deposit to Polarity Ratio during deposition.

With one version of this embodiment, the step of driving the power supply comprises the steps of: comparing the specified average grain size to at least one index grain size and, using the first constitutive relation, identifying a proportion of active metal in a deposit corresponding to the specified grain size; comparing the corresponding proportion of active metal to at least one index proportion of active metal and using the second constitutive relationship, identifying a Polarity Ratio corresponding to the proportion of most active metal that corresponds to the specified grain size; and driving the power supply to establish the identified Polarity Ratio that corresponds to the proportion of most active metal that corresponds to the specified grain size.

The first constitutive relation may include an explicit correspondence between the specified grain size and a proportion of most active metal.

The first constitutive relation may include an explicit correspondence between an index grain size that differs from the specified grain size, and a proportion of active metal, and also may include slope information that relates change in grain size to change in proportion of most active metal, which enables deriving a proportion of most active metal that corresponds to the specified grain size.

Also according to this embodiment of an invention hereof, the second constitutive relation may include an explicit correspondence between the proportion of most active metal that corresponds to the specified grain size and Polarity Ratio.

An alternative version of this embodiment is that the second constitutive relation includes an explicit correspondence between an index proportion of most active metal that differs from the proportion of most active metal that corresponds to the specified grain size, and also includes slope information that relates change in proportion of most active metal to change in Polarity Ratio, which enables deriving a Polarity Ratio that corresponds to the proportion of most active metal that corresponds to the specified grain size.

Yet another embodiment of an invention disclosed herein is a method for determining parameters for depositing at an electrode, an alloy of a system comprising at least two elements, one of which is most electro-active and at least one of which is a metal. The alloy deposit has a specified nanocrystalline average grain size. The deposition uses a first electrode and a second electrode, at which the alloy will deposit. The electrodes reside in a liquid comprising dissolved species of at least two elements of the system, at least one of which elements is the metal and at least one of which is the most electro-active element. The electrodes are driven by a power supply configured to provide electrical potential having periods of positive polarity and negative polarity at different times. The method of determining parameters comprises the steps of: selecting a bath composition comprising dissolved species of the at least two elements of the system; and determining a Polarity Ratio to supply to the electrodes during deposition by: determining a proportion of the most active element in the deposit composition that corresponds to the specified grain size, based on a constitutive relation that expresses average grain size as a function of proportion; and determining a Polarity Ratio supplied during deposit that corresponds to the proportion that corresponds to the specified grain size, based on a constitutive relation that expresses proportion as a function of Polarity Ratio.

In yet another preferred embodiment, an invention that is disclosed is a method for determining parameters for depositing at an electrode, an alloy of a system comprising at least two elements, one of which is most electro-active and at least one of which is metal, the deposit having a specified nanocrystalline grain size, the deposition using a first electrode and a second electrode at which the alloy will deposit, the electrodes residing in a liquid comprising dissolved species of at least two elements of the system, at least one of which is the metal and at least one of which is the most electro-active, the electrodes being driven by a power supply that is configured to provide electrical potential having periods of positive polarity and negative polarity at different times. The method of determining parameters comprises the steps of: selecting a bath composition comprising dissolved species of the at least two elements, and determining a Polarity Ratio to supply to the electrodes during deposition, which corresponds to the specified grain size, based on a constitutive relation that expresses grain size as a function of supplied Polarity Ratio.

According to another preferred embodiment, an invention hereof is an article of manufacture of a metal alloy comprising at least two elements, the article comprising: a first layer region having a nanocrystalline structure with a first average grain size; and adjacent the first layer region, and in contact therewith, a second layer region having a nanocrystalline structure with a second average grain size, which second size differs from the first size. With this embodiment, the article exhibits failure modes that are dominated by phenomena other than the propagation of pre-existing cracks.

A similar embodiment exhibits failure modes that are dominated by phenomena other than crack initiation and propagation from pre-existing voids, rather than cracks.

A related preferred embodiment further entails an article, further wherein, one of the layer regions has a nanocrystalline structure with a variation in average grain size, such that the variation region has a first average grain size at a first location and spaced therefrom, at a second location, the variation region has a second, different average grain size, with varying average grain sizes between the first and second locations.

A similar preferred embodiment of an invention hereof is an article of manufacture of a metal alloy comprising at least two elements, the article comprising a region having a nanocrystalline structure with a variation in average grain size, such that the variation region has: a first average grain size at a first location; and spaced therefrom, at a second location, a second, different average grain size, with varied average grain sizes between the first and second locations. Further, the article exhibits failure modes that are dominated by phenomena other than crack propagation from pre-existing cracks.

A similar embodiment exhibits failure modes that are dominated by phenomena other than crack initiation and propagation from pre-existing voids, rather than cracks.

For yet another embodiment, an invention hereof is a method for depositing an alloy of a system comprising at least two elements, one of which being most electro-active and at least one of which being a metal, an alloy deposit having a first layer region having a nanocrystalline structure with a first average grain size adjacent said first layer region, and in contact therewith, a second layer region having a nanocrystalline structure with a second average grain size, which second size differs from the first size. The method comprises the steps of: providing a liquid comprising dissolved species of at least two elements of the system, at least one of which elements is the metal and at least one of which elements is the most electro-active; providing a first electrode and a second electrode in the liquid, coupled to a power supply configured to supply electrical potential having periods of positive polarity and negative polarity at different times; driving the power supply for a first period of time to achieve the first specified grain size deposit at the second electrode, with a non-constant electrical potential having positive polarity and negative polarity at different times, which times and polarities characterize a first Polarity Ratio; and driving the power supply for a second period of time to achieve the second specified grain size deposit at the second electrode, with a non-constant electrical potential having positive polarity and negative polarity at different times, which times and polarities characterize a second Polarity Ratio that differs from the first Polarity Ratio.

According to a related embodiment, one of the layer regions comprises a region having a nanocrystalline structure with a variation in average grain size, such that the variation region has a first average grain size at a first location and spaced therefrom, at a second location, the variation region has a second, different average grain size, with varying average grain sizes between the first and second locations. The step of driving the power supply for a second period of time further comprises driving the power supply with a non-constant electrical potential having positive polarity and negative polarity at different times, which times and polarities characterize a range of non-constant Polarity Ratios that correspond to a range of different average grain sizes.

Still another embodiment of an invention hereof is a method for depositing an alloy of a system comprising at least two elements, one of which being most electro-active and at least one of which being a metal, the method comprising the steps of: providing an electroplating liquid comprising dissolved elements of the system; providing a first electrode and a second electrode in the liquid; driving the power supply for a first period of time with a non-constant electrical potential that characterizes a first Polarity Ratio; and driving the power supply for a second period of time with a non-constant electrical potential that characterize a second Polarity Ratio that differs from the first Polarity Ratio.

According to another embodiment of an invention hereof, a method is for depositing an alloy of a system comprising at least two elements, one of which being most electro-active and at least one of which being a metal, an alloy deposit having a variation in average grain size, such that the deposit has a first average grain size at a first location and spaced therefrom, at a second location, the deposit has a second, different average grain size, with varying average grain sizes between the first and second locations. The method comprises the steps of: providing a liquid comprising dissolved species of at least two elements of the system, at least one of which elements is the metal and at least one of which elements is the most electro-active; providing a first electrode and a second electrode in the liquid, coupled to a power supply configured to supply electrical potential having periods of positive polarity and negative polarity at different times; and driving the power supply for a period of time with a non-constant electrical potential having positive polarity and negative polarity at different times, which times and polarities characterize a range of non-constant Polarity Ratios, which correspond to a range of different average grain sizes.

One more embodiment of an invention hereof is a method for depositing an alloy of a system comprising at least two elements, one of which being most electro-active and at least one of which being a metal. The method comprises the steps of: providing an electro-plating liquid comprising elements of the system; providing a first electrode and a second electrode in the liquid, coupled to a power supply; and driving the power supply for a period of time characterized by a range of non-constant Polarity Ratios, which correspond to a range of different average grain sizes.

Preferred embodiments of any of the method inventions mentioned herein include a method where the deposit comprises a coating upon a substrate or an object free-standing from any electrode. The coating may be decorative, and/or may protect against abrasion, corrosion, and/or may function as a hard chrome coating. The substrate may comprise steel, stainless steel, aluminum, brass, many metals, or plastic having an electro-conductive surface.

For any of these variations involving constitutive relations, at least one of the first and second constitutive relations may comprises a continuous function, a table, a mathematical formula, a point and slope information, or any combination thereof.

Preferred embodiments of any of the article of manufacture inventions mentioned herein include an article where the deposit comprises a coating upon a substrate or an object free-standing from any electrode. The coating may be decorative, and/or may protect against abrasion, and/or corrosion, and/or may function as a hard chrome coating. The substrate may comprise steel, stainless steel, aluminum, brass, many metals, or plastic having an electro-conductive surface.

Many techniques and aspects of the inventions have been described herein. The person skilled in the art will understand that many of these techniques can be used with other disclosed techniques, even if they have not been specifically described in use together. For instance, layered embodiments can themselves be graded with varying grain size within a layer, or can be arranged as discrete layers, with varying grain size from layer to layer, in a graded fashion. Differing Polarity Ratios can be achieved by varying the duration or the amplitude of the negative portion of the electrical signal or both. The constitutive relations can be continuous, such as functions, or densely packed tables, or less continuous, and they can be highly continuous at one portion of their range, and less so at other portions. The coatings may have more than one property, such as abrasion resistant and decorative, in any combination of all of the properties listed and other reasonably desirable properties. The methods of coating described can be used with the methods described for selecting parameters or with any other method for selecting parameters that achieves useful results. The resulting end product may retain a substrate, or may be wholly coating, the substrate having been removed by some appropriate fashion. The coatings may also be used with coatings that have average grain size that are larger than the nanocrystalline scale for other portions of an article, for instance interior or exterior to the nanocrystalline region fashioned according to an invention herof.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

What is claimed is:

1. A method for depositing an alloy of a system comprising at least two elements, one of which being most electro-active and at least one of which being a metal, an alloy deposit having a first layer region having a nanocrystalline structure with a first average grain size, and adjacent said first layer region, and in contact therewith, a second layer region having a nanocrystalline structure with a second average grain size, which second size differs from the first size, the method for depositing comprising the steps of:

a. providing a liquid comprising dissolved species of at least two elements of the system, at least one of which elements is the metal and at least one of which elements is the most electro-active;

b. providing a first electrode and a second electrode in the liquid, coupled to a power supply configured to supply electrical potential having periods of positive polarity and negative polarity at different times;

c. driving the power supply for a first period of time to achieve the first specified grain size alloy deposit of the at least two elements at the second electrode, with a non-constant electrical potential having positive polarity and negative polarity at different times, which times and polarities characterize a first Polarity Ratio, which has been selected with reference to a constitutive relation that relates the first specified average grain size alloy deposit to the first polarity ratio; and;

d. driving the power supply for a second period of time to achieve the second specified grain size alloy deposit at the second electrode, with a non-constant electrical potential having positive polarity and negative polarity at different times, which times and polarities characterize a second Polarity Ratio that differs from the first Polarity Ratio, the second polarity ratio having been selected with reference to a constitutive relation that relates the second specified average grain size alloy deposit to the second polarity ratio.

2. The method of depositing of claim 1, further wherein, one of the layer regions comprises a variation region having a nanocrystalline structure with a variation in average grain size, such that the variation region has a first average grain size at a first location and spaced therefrom, at a second location, the variation region has a second, different average grain size, with varying average grain sizes in a size range, located between the first and second locations, the step of driving the power supply for a second period of time further comprises driving the power supply with a non-constant electrical potential having positive polarity and negative polarity at different times, which times and polarities characterize a range of non-constant Polarity Ratios that correspond to a range of different average grain sizes within the size range.

3. The method of depositing of claim 1, further where said step of driving the power supply comprises comparing the specified average grain size to at least one index grain size and driving the power supply to establish a polarity ratio that has been selected with reference to a constitutive relation that relates the at least one index grain size to a corresponding Polarity Ratio and which also includes slope information that relates change in grain size to change in polarity ratio.

4. The method of depositing of claim 1, further where said step of driving the power supply comprises driving the power supply to establish a polarity ratio that was determined with reference to:

i. a first constitutive relation that relates electrodeposited average grain size of a deposit to a proportion of the most electro-active metal in the deposit; and ii. a second constitutive relation that relates the proportion of the most electro-active metal in a deposit to polarity ratio during deposition.

5. The method of claim 1, the at least two elements comprising nickel and tungsten.

6. The method of claim 1, the at least two elements comprising nickel and molybdenum.

7. The method of claim 1, the at least two elements comprising cobalt and tungsten.

8. The method of claim 1, the at least two elements comprising cobalt and molybdenum.

9. The method of depositing of claim 1, at least one of two elements comprising a metal selected from the group consisting of: tungsten, molybdenum, nickel and Cobalt.

10. A method for depositing an alloy of a system comprising at least two elements, one of which being most electro-active and at least one of which being a metal, an alloy deposit having a variation in average grain size, such that a variation region has a first average grain size at a first location and spaced therefrom, at a second location, the variation region has a second, different average grain size, with varying average grain sizes in a size range, located between the first and second locations, the method for depositing comprising the steps of:

a. providing a liquid comprising dissolved species of at least two elements of the system, at least one of which elements is the metal and at least one of which elements is the most electro-active;

b. providing a first electrode and a second electrode in the liquid, coupled to a power supply configured to supply electrical potential having periods of positive polarity and negative polarity at different times; and c. driving the power supply for a period of time with a non-constant electrical potential having positive polarity and negative polarity at different times, which times and polarities characterize a range of non-constant Polarity Ratios, between a first polarity ratio and a second polarity ratio, with varying polarity ratios within the range of polarity ratios, which range of polarity ratios correspond to the range of different average grain sizes of an alloy deposit, of the at least two elements, thereby achieving the first average grain size alloy deposit at the first location and the second average grain size alloy deposit at the second location, with varying average grain sizes located between the first and second locations, the first and second polarity ratios and the polarity ratios within the range of polarity ratios having been selected with reference to a constitutive relation that relates each different average grain size to a polarity ratio.

11. The method of depositing of claim 10, further where said step of driving the power supply comprises comparing the specified average grain size to at least one index grain size and driving the power supply to establish a polarity ratio, that has been selected with reference to a constitutive relation that relates the at least one index grain size to a corresponding polarity ratio and which also includes slope information that relates change in grain size to change in polarity ratio.

12. The method of depositing of claim 10, further where said step of driving the power supply comprises driving the power supply to establish a Polarity Ratio that was determined with reference to:

i. a first constitutive relation that relates electrodeposited average grain size of a deposit to a proportion of the most electro-active metal in the deposit; and ii. a second constitutive relation that relates the proportion of the most electro-active metal in a deposit to polarity ratio during deposition.

13. The method of claim 10, the at least two elements comprising nickel and tungsten.

14. The method of claim 10, the at least two elements comprising nickel and molybdenum.

15. The method of claim 10, the at least two elements comprising cobalt and tungsten.

16. The method of claim 10, the at least two elements comprising cobalt and molybdenum.

17. The method of depositing of claim 10, at least one of two elements comprising a metal selected from the group consisting of: tungsten, molybdenum, nickel and Cobalt.

18. A method for depositing an alloy of a system comprising at least two elements, one of which being most electro-active and at least one of which being a metal, comprising the steps of:

a. providing an electro-plating liquid comprising elements of the system;

b. providing a first electrode and a second electrode in the liquid, coupled to a power supply; and c. driving the power supply for a period of time characterized by a range of non-constant Polarity Ratios, between a first polarity ratio and a second polarity ratio, with varying polarity ratios within the range of polarity ratios, which range of polarity ratios corresponds to a range of different average grain sizes, of a deposit of the alloy of at least two elements, the correspondence being based on a constitutive relation that relates each different average grain size of a deposit to a polarity ratio, thereby achieving a first average grain size alloy deposit at a first location and a second average grain size alloy deposit at a second location, with varying average grain size deposits between the first and second locations.

19. The method of claim 18, the at least two elements comprising nickel and tungsten.

20. The method of claim 18, the at least two elements comprising nickel and molybdenum.

21. The method of claim 18, the at least two elements comprising cobalt and tungsten.

22. The method of claim 18, the at least two elements comprising cobalt and molybdenum.

* * * * *